US011603715B2

(12) United States Patent
Reese et al.

(10) Patent No.: US 11,603,715 B2
(45) **Date of Patent: *Mar. 14, 2023**

(54) SUCKER ROD COUPLINGS AND TOOL JOINTS WITH POLYCRYSTALLINE DIAMOND ELEMENTS

(71) Applicant: XR Reserve LLC, Houston, TX (US)

(72) Inventors: Michael R. Reese, Houston, TX (US); David P. Miess, Spring, TX (US); Gregory Prevost, Spring, TX (US); Edward C. Spatz, Spring, TX (US); William W. King, Houston, TX (US)

(73) Assignee: XR Reserve LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/461,382

(22) Filed: Aug. 30, 2021

(65) Prior Publication Data

US 2022/0178214 A1 Jun. 9, 2022

Related U.S. Application Data

(63) Continuation-in-part of application No. 16/529,310, filed on Aug. 1, 2019, now Pat. No. 11,225,842.

(60) Provisional application No. 63/083,252, filed on Sep. 25, 2020, provisional application No. 62/713,681, filed on Aug. 2, 2018.

(51) Int. Cl.
*E21B 17/10* (2006.01)
*E21B 43/12* (2006.01)

(52) U.S. Cl.
CPC ..... *E21B 17/1071* (2013.01); *E21B 17/1085* (2013.01); *E21B 43/127* (2013.01)

(58) Field of Classification Search
CPC ..... E21B 17/1071; E21B 17/1085
See application file for complete search history.

(56) References Cited

U.S. PATENT DOCUMENTS

| | | | |
|---|---|---|---|
| 1,798,604 | A | 3/1931 | Hoke |
| 1,963,956 | A | 6/1934 | James |
| 2,259,023 | A | 10/1941 | Clark |
| 2,299,978 | A | 10/1942 | Hall |
| 2,407,586 | A | 9/1946 | Summers |
| 2,567,735 | A | 9/1951 | Scott |
| 2,693,396 | A | 11/1954 | Gondek |
| 2,758,181 | A | 8/1956 | Crouch |

(Continued)

FOREIGN PATENT DOCUMENTS

| | | | |
|---|---|---|---|
| CA | 2891268 | A1 | 11/2016 |
| DE | 1226986 | A1 | 2/1994 |

(Continued)

OTHER PUBLICATIONS

Bovenkerk, Dr. H. P.; Bundy, Dr. F. P.; Hall, Dr. H. T.; Strong, Dr. H. M.; Wentorf, Jun., Dr. R. H. Preparation of Diamond, Nature, Oct. 10, 1959, pp. 1094-1098, vol. 184.

(Continued)

*Primary Examiner* — Kristyn A Hall
(74) *Attorney, Agent, or Firm* — Michael S. McCoy; Amatong McCoy LLC

(57) ABSTRACT

The present disclosure includes sucker rod strings, pipe protectors, and tool joints having polycrystalline diamond elements positioned thereon to interface engagement with other surfaces in downhole applications. The polycrystalline diamond elements can be positioned on sucker rod guides, sucker rod couplers, pipe protectors, and tool joints.

25 Claims, 12 Drawing Sheets

(56) References Cited

U.S. PATENT DOCUMENTS 2,788,677 A 4/1957 Hayek
2,877,662 A 3/1959 Eduard
2,897,016 A 7/1959 Baker
2,947,609 A 8/1960 Strong
2,947,610 A 8/1960 Hall et al.
3,132,904 A 5/1964 Kohei et al.
3,559,802 A 2/1971 Eidus
3,582,161 A 6/1971 Hudson
3,603,652 A 9/1971 Youden
3,650,714 A 3/1972 Farkas
3,697,141 A 10/1972 Garrett
3,707,107 A 12/1972 Bieri
3,741,252 A 6/1973 Williams
3,745,623 A 7/1973 Wentorf et al.
3,752,541 A 8/1973 Mcvey
3,866,987 A 2/1975 Gamer
3,869,947 A 3/1975 Vandenkieboom
3,920,290 A 11/1975 Evarts
4,085,634 A 4/1978 Sattler
4,182,537 A 1/1980 Oster
4,225,322 A 9/1980 Knemeyer
4,238,137 A 12/1980 Furchak et al.
4,275,935 A 6/1981 Thompson et al.
4,285,550 A 8/1981 Blackburn et al.
4,364,136 A 12/1982 Hattan
4,382,637 A 5/1983 Blackburn et al.
4,398,772 A 8/1983 Odell
4,410,054 A 10/1983 Nagel et al.
4,410,284 A 10/1983 Herrick
4,428,627 A 1/1984 Teramachi
4,432,682 A 2/1984 McKewan
4,468,138 A 8/1984 Nagel
4,525,178 A 6/1985 Hall
4,554,208 A 11/1985 MacIver et al.
4,560,014 A 12/1985 Geczy
4,620,601 A 11/1986 Nagel
RE32,380 E 3/1987 Wentorf, Jr. et al.
4,662,348 A 5/1987 Hall et al.
4,679,639 A 7/1987 Barr et al.
4,689,847 A 9/1987 Huber
4,720,199 A 1/1988 Geczy et al.
4,729,440 A 3/1988 Hall
4,732,490 A 3/1988 Masciarelli
4,738,322 A 4/1988 Hall et al.
4,764,036 A 8/1988 McPherson
4,796,670 A 1/1989 Russell et al.
4,797,011 A 1/1989 Saeki et al.
4,858,688 A 8/1989 Edwards et al.
4,906,528 A 3/1990 Cerceau et al.
4,938,299 A 7/1990 Jelsma
4,958,692 A 9/1990 Anderson
5,011,514 A 4/1991 Cho et al.
5,011,515 A 4/1991 Frushour
5,030,276 A 7/1991 Sung et al.
5,037,212 A 8/1991 Justman et al.
5,066,145 A 11/1991 Sibley et al.
5,067,826 A 11/1991 Lemelson
5,092,687 A 3/1992 Hall
5,112,146 A 5/1992 Stangeland
5,123,772 A 6/1992 Anderson
5,151,107 A 9/1992 Cho et al.
5,176,483 A 1/1993 Baumann et al.
5,193,363 A 3/1993 Petty
5,205,188 A 4/1993 Repenning et al.
5,253,939 A 10/1993 Hall
5,271,749 A 12/1993 Rai et al.
5,351,770 A 10/1994 Cawthorne et al.
5,358,041 A 10/1994 O'Hair
5,358,337 A 10/1994 Codatto
5,375,679 A 12/1994 Biehl
5,385,715 A 1/1995 Fish
5,447,208 A 9/1995 Lund et al.
5,462,362 A 10/1995 Yuhta et al.
5,464,086 A 11/1995 Coelln
5,514,183 A 5/1996 Epstein et al.
5,522,467 A 6/1996 Stevens et al.
5,533,604 A 7/1996 Brierton
5,538,346 A 7/1996 Frias et al.
5,540,314 A 7/1996 Coelln
5,560,716 A 10/1996 Tank et al.
5,618,114 A 4/1997 Katahira
5,645,617 A 7/1997 Frushour
5,653,300 A 8/1997 Lund et al.
5,715,898 A 2/1998 Anderson
5,810,100 A 9/1998 Samford
5,833,019 A 11/1998 Gynz-Rekowski
5,855,996 A 1/1999 Corrigan et al.
5,948,541 A 9/1999 Inspektor
6,045,029 A 4/2000 Scott
6,109,790 A 8/2000 Gynz-Rekowski et al.
6,120,185 A 9/2000 Masciarelli, Jr.
6,129,195 A 10/2000 Matheny
6,152,223 A 11/2000 Abdo et al.
6,164,109 A 12/2000 Bartosch
6,209,185 B1 4/2001 Scott
6,279,716 B1 8/2001 Kayatani et al.
6,378,633 B1 4/2002 Moore et al.
6,409,388 B1 6/2002 Lin
6,457,865 B1 10/2002 Masciarelli, Jr.
6,488,103 B1 12/2002 Dennis et al.
6,488,715 B1 12/2002 Pope et al.
6,516,934 B2 2/2003 Masciarelli, Jr.
6,517,583 B1 2/2003 Pope et al.
6,652,201 B2 11/2003 Kunimori et al.
6,655,845 B1 12/2003 Pope et al.
6,737,377 B1 5/2004 Sumiya et al.
6,764,219 B2 7/2004 Doll et al.
6,808,019 B1 10/2004 Mabry
6,814,775 B2 11/2004 Scurlock et al.
6,951,578 B1 10/2005 Belnap et al.
7,007,787 B2 3/2006 Pallini et al.
7,128,173 B2 10/2006 Lin
7,198,043 B1 4/2007 Zhang
7,234,541 B2 6/2007 Scott et al.
7,311,159 B2 12/2007 Lin et al.
7,441,610 B2 10/2008 Belnap et al.
7,475,744 B2 1/2009 Pope
7,552,782 B1 6/2009 Sexton et al.
7,703,982 B2 4/2010 Cooley
7,737,377 B1 6/2010 Dodal et al.
7,845,436 B2 12/2010 Cooley et al.
7,861,805 B2 1/2011 Dick et al.
7,870,913 B1 1/2011 Sexton et al.
8,069,933 B2 12/2011 Sexton et al.
8,109,247 B2 2/2012 Wakade et al.
8,119,240 B2 2/2012 Cooper
8,163,232 B2 4/2012 Fang et al.
8,277,124 B2 10/2012 Sexton et al.
8,277,722 B2 10/2012 DiGiovanni
8,365,846 B2 2/2013 Dourfaye et al.
8,480,304 B1 7/2013 Cooley et al.
8,485,284 B2 7/2013 Sithebe
8,613,554 B2 12/2013 Tessier et al.
8,627,904 B2 1/2014 Voronin
8,678,657 B1 3/2014 Knuteson et al.
8,701,797 B2 4/2014 Baudoin
8,702,824 B1 4/2014 Sani et al.
8,734,550 B1 5/2014 Sani
8,757,299 B2 6/2014 DiGiovanni et al.
8,763,727 B1 7/2014 Cooley et al.
8,764,295 B2 7/2014 Dadson et al.
8,789,281 B1 7/2014 Sexton et al.
8,881,849 B2 11/2014 Shen et al.
8,939,652 B2 1/2015 Peterson et al.
8,974,559 B2 3/2015 Frushour
9,004,198 B2 4/2015 Kulkarni
9,010,418 B2 4/2015 Pereyra et al.
9,045,941 B2 6/2015 Chustz
9,103,172 B1 8/2015 Bertagnolli et al.
9,127,713 B1 9/2015 Lu
9,145,743 B2 9/2015 Shen et al.
9,222,515 B2 12/2015 Chang
9,273,381 B2 3/2016 Qian et al.
9,284,980 B1 3/2016 Miess

(56) References Cited

U.S. PATENT DOCUMENTS

| | | | |
|---|---|---|---|
| 9,309,923 | B1 | 4/2016 | Lingwall et al. |
| 9,353,788 | B1 | 5/2016 | Tulett et al. |
| 9,366,085 | B2 | 6/2016 | Panahi |
| 9,404,310 | B1 | 8/2016 | Sani et al. |
| 9,410,573 | B1 | 8/2016 | Lu |
| 9,429,188 | B2 | 8/2016 | Peterson et al. |
| 9,488,221 | B2 | 11/2016 | Gonzalez |
| 9,562,562 | B2 | 2/2017 | Peterson |
| 9,643,293 | B1 | 5/2017 | Miess et al. |
| 9,702,401 | B2 | 7/2017 | Gonzalez |
| 9,732,791 | B1 | 8/2017 | Gonzalez |
| 9,776,917 | B2 | 10/2017 | Tessitore et al. |
| 9,790,749 | B2 | 10/2017 | Chen |
| 9,790,818 | B2 | 10/2017 | Berruet et al. |
| 9,803,432 | B2 | 10/2017 | Wood et al. |
| 9,822,523 | B1 | 11/2017 | Miess |
| 9,840,875 | B2 | 12/2017 | Harvey et al. |
| 9,869,135 | B1 | 1/2018 | Martin |
| 10,060,192 | B1 | 8/2018 | Miess et al. |
| 62,713,681 | | 8/2018 | Reese |
| 10,113,362 | B2 | 10/2018 | Ritchie et al. |
| 10,279,454 | B2 | 5/2019 | DiGiovanni et al. |
| 10,294,986 | B2 | 5/2019 | Gonzalez |
| 10,307,891 | B2 | 6/2019 | Daniels et al. |
| 10,408,086 | B1 | 9/2019 | Meier |
| 10,465,775 | B1 | 11/2019 | Miess et al. |
| 10,683,895 | B2 | 6/2020 | Hall et al. |
| 10,711,792 | B2 | 7/2020 | Vidalenc et al. |
| 10,711,833 | B2 | 7/2020 | Manwill et al. |
| 10,738,821 | B2 | 8/2020 | Miess et al. |
| 10,807,913 | B1 | 10/2020 | Hawks et al. |
| 10,968,700 | B1 | 4/2021 | Raymond |
| 10,968,703 | B2 | 4/2021 | Haugvaldstad et al. |
| 11,054,000 | B2 | 7/2021 | Prevost et al. |
| 11,085,488 | B2 | 8/2021 | Gonzalez |
| 2002/0020526 | A1 | 2/2002 | Male et al. |
| 2003/0019106 | A1 | 1/2003 | Pope et al. |
| 2003/0075363 | A1 | 4/2003 | Lin et al. |
| 2003/0159834 | A1 | 8/2003 | Kirk et al. |
| 2003/0220691 | A1 | 11/2003 | Songer et al. |
| 2004/0031625 | A1 | 2/2004 | Lin et al. |
| 2004/0134687 | A1 | 7/2004 | Radford et al. |
| 2004/0163822 | A1 | 8/2004 | Zhang et al. |
| 2004/0219362 | A1 | 11/2004 | Wort et al. |
| 2004/0223676 | A1 | 11/2004 | Pope et al. |
| 2006/0060392 | A1 | 3/2006 | Eyre |
| 2006/0165973 | A1 | 7/2006 | Dumm et al. |
| 2007/0046119 | A1 | 3/2007 | Cooley |
| 2008/0217063 | A1 | 9/2008 | Moore et al. |
| 2008/0253706 | A1 | 10/2008 | Bischof et al. |
| 2009/0020046 | A1 | 1/2009 | Marcelli |
| 2009/0087563 | A1 | 4/2009 | Voegele et al. |
| 2009/0268995 | A1 | 10/2009 | Ide et al. |
| 2010/0037864 | A1 | 2/2010 | Dutt et al. |
| 2010/0276200 | A1 | 11/2010 | Schwefe et al. |
| 2010/0307069 | A1 | 12/2010 | Bertagnolli et al. |
| 2011/0174547 | A1 | 7/2011 | Sexton et al. |
| 2011/0203791 | A1 | 8/2011 | Jin et al. |
| 2011/0220415 | A1 | 9/2011 | Jin et al. |
| 2011/0297454 | A1 | 12/2011 | Shen et al. |
| 2012/0037425 | A1 | 2/2012 | Sexton et al. |
| 2012/0057814 | A1 | 3/2012 | Dadson et al. |
| 2012/0225253 | A1 | 9/2012 | DiGiovanni et al. |
| 2012/0281938 | A1 | 11/2012 | Peterson et al. |
| 2013/0000442 | A1 | 1/2013 | Wiesner et al. |
| 2013/0004106 | A1 | 1/2013 | Wenzel |
| 2013/0092454 | A1 | 4/2013 | Scott et al. |
| 2013/0146367 | A1 | 6/2013 | Zhang et al. |
| 2013/0170778 | A1 | 7/2013 | Higginbotham et al. |
| 2014/0037232 | A1 | 2/2014 | Marchand et al. |
| 2014/0176139 | A1 | 6/2014 | Espinosa et al. |
| 2014/0254967 | A1 | 9/2014 | Gonzalez |
| 2014/0341487 | A1 | 11/2014 | Cooley et al. |
| 2014/0355914 | A1 | 12/2014 | Cooley et al. |
| 2015/0027713 | A1 | 1/2015 | Penisson |
| 2015/0132539 | A1 | 5/2015 | Bailey et al. |
| 2015/0330150 | A1 | 11/2015 | Strachan |
| 2016/0153243 | A1 | 6/2016 | Hinz et al. |
| 2016/0312535 | A1 | 10/2016 | Ritchie et al. |
| 2017/0030393 | A1 | 2/2017 | Phua et al. |
| 2017/0114597 | A1 | 4/2017 | Chevalier et al. |
| 2017/0138224 | A1 | 5/2017 | Henry et al. |
| 2017/0234071 | A1 | 8/2017 | Spalz et al. |
| 2017/0261031 | A1 | 9/2017 | Gonzalez et al. |
| 2018/0087134 | A1 | 3/2018 | Chang et al. |
| 2018/0209476 | A1 | 7/2018 | Gonzalez |
| 2018/0216661 | A1 | 8/2018 | Gonzalez |
| 2018/0264614 | A1 | 9/2018 | Winkelmann et al. |
| 2018/0320740 | A1 | 11/2018 | Hall et al. |
| 2019/0063495 | A1 | 2/2019 | Peterson et al. |
| 2019/0136628 | A1 | 5/2019 | Savage et al. |
| 2019/0170186 | A1 | 6/2019 | Gonzalez et al. |
| 2020/0031586 | A1 | 1/2020 | Miess et al. |
| 2020/0032841 | A1 | 1/2020 | Miess et al. |
| 2020/0032846 | A1 | 1/2020 | Miess et al. |
| 2020/0056659 | A1 | 2/2020 | Prevost et al. |
| 2020/0063498 | A1 | 2/2020 | Prevost et al. |
| 2020/0063503 | A1 | 2/2020 | Reese et al. |
| 2020/0165881 | A1 | 5/2020 | Nommensen |
| 2020/0182290 | A1 | 6/2020 | Doehring et al. |
| 2020/0325933 | A1 | 10/2020 | Prevost et al. |
| 2020/0362956 | A1 | 11/2020 | Prevost et al. |
| 2020/0378440 | A1 | 12/2020 | Prevost et al. |
| 2021/0140277 | A1 | 5/2021 | Hall et al. |
| 2021/0148406 | A1 | 5/2021 | Hoyle et al. |
| 2021/0198949 | A1 | 7/2021 | Haugvaldstad et al. |
| 2021/0207437 | A1 | 7/2021 | Raymond |
| 2021/0222734 | A1 | 7/2021 | Gonzalez et al. |

FOREIGN PATENT DOCUMENTS

| | | | |
|---|---|---|---|
| DE | 29705983 | U1 | 6/1997 |
| JP | 56061404 | A | 4/1985 |
| JP | 06174051 | A | 6/1994 |
| JP | 2004002912 | A | 1/2004 |
| JP | 2008056735 | A | 3/2008 |
| WO | 8700080 | A1 | 1/1987 |
| WO | 2004001238 | A2 | 12/2003 |
| WO | 2006011028 | A1 | 2/2006 |
| WO | 2006028327 | A1 | 3/2006 |
| WO | 2013043917 | A1 | 3/2013 |
| WO | 2014014673 | A1 | 1/2014 |
| WO | 2014189763 | A1 | 11/2014 |
| WO | 2016089680 | A1 | 6/2016 |
| WO | 2017105883 | A1 | 6/2017 |
| WO | 2018041578 | A1 | 3/2018 |
| WO | 2018132915 | A1 | 7/2018 |
| WO | 2018226380 | A1 | 12/2018 |
| WO | 2019096851 | A1 | 5/2019 |

OTHER PUBLICATIONS

Chen, Y.; Nguyen, T; Zhang, L.C.; Polishing of polycrystalline diamond by the technique of dynamic friction-Part 5: Quantitative analysis of material removal, International Journal of Machine Tools & Manufacture, 2009, pp. 515-520, vol. 49, Elsevier.

Chen, Y.; Zhang, L.C.; Arsecularatne, J.A.; Montross, C.; Polishing of polycrystalline diamond by the technique of dynamic friction, part 1: Prediction of the interface temperature rise, International Journal of Machine Fools & Manufacture, 2006, pp. 580-587, vol. 46, Elsevier.

Chen, Y.; Zhang, L.C.; Arsecularatne, J.A.; Polishing of polycrystalline diamond by the technique of dynamic friction. Part 2: Material removal mechanism, International Journal of Machine Tools & Manufacture, 2007, pp. 1615-1624, vol. 47, Elsevier.

Chen, Y.; Zhang, L.C.; Arsecularatne, J.A.; Zarudi, I., Polishing of polycrystalline diamond by the technique of dynamic friction, part 3: Mechanism exploration through debris analysis, International Journal of Machine Tools & Manufacture, 2007, pp. 2282-2289, vol. 47, Elsevier.

Chen, Y.; Zhang, L.C.; Polishing of polycrystalline diamond by the

(56) References Cited

OTHER PUBLICATIONS technique of dynamic friction, part 4: Establishing the polishing map, International Journal of Machine Tools & Manufacture, 2009, pp. 309-314, vol. 49, Elsevier.
Dobrzhinetskaya, Larissa F.; Green, II, Harry W.; Diamond Synthesis from Graphite in the Presence of Water and SiO2: Implications for Diamond Formation in Quartzites from Kazakhstan, International Geology Review, 2007, pp. 389-400, vol. 49.
Element six, The Element Six CVD Diamond Handbook, Accessed on Nov. 1, 2019, 28 pages.
Grossman, David, What the World Needs Now is Superhard Carbon, Popular Mechanics, https://www.popularmechanics.com/science/environment/a28970718/superhard-materials/,Sep. 10, 2019, 7 pages, Hearst Magazine Media, Inc.
Hudson Bearings Air Cargo Ball Transfers brochure, accessed on Jun. 23, 2018, 8 Pages, Columbus, Ohio.
Hudson Bearings Air Cargo Ball Transfers Installation and Maintenance Protocols, accessed on Jun. 23, 2018, pp. 1-5.
International Search Report and Written Opinion dated Aug. 3, 2020 (issued in PCT Application No. PCT/US20/21549) [11 pages].
International Search Report and Written Opinion dated Aug. 4, 2020 (issued in PCT Application No. PCT/US2020/034437) [10 pages].
International Search Report and Written Opinion dated Dec. 21, 2021 (issued in PCT Application No. PCT/US21/48247) [10 pages].
International Search Report and Written Opinion dated Feb. 3, 2022 (issued in PCT Application No. PCT/US21/58584) [14 pages].
International Search Report and Written Opinion dated Jan. 15, 2021 (issued in PCT Application No. PCT/US2020/049382) [18 pages].
International Search Report and Written Opinion dated Oct. 21, 2019 (issued in PCT Application No. PCT/US2019/043746) [14 pages].
International Search Report and Written Opinion dated Oct. 22, 2019 (issued in PCT Application No. PCT/US2019/043744) [11 pages].
International Search Report and Written Opinion dated Oct. 25, 2019 (issued in PCT Application No. PCT/US2019/044682) [20 pages].
International Search Report and Written Opinion dated Oct. 29, 2019 (issued in PCT Application No. PCT/US2019/043741) [15 pages].
International Search Report and Written Opinion dated Sep. 2, 2020 (issued in PCT Application No. PCT/US20/37048) [8 pages].
International Search Report and Written Opinion dated Sep. 8, 2020 (issued in PCT Application No. PCT/US20/35316) [9 pages].
International Search Report and Written Opinion dated Sep. 9, 2019 (issued in PCT Application No. PCT/US2019/043732) [10 pages].
International Search Report and Written Opinion dated Sep. 9, 2020 (issued in PCT Application No. PCT/US20/32196) [13 pages].
Liao, Y.; Marks, L.; In situ single asperity wear at the nanometre scale, International Materials Reviews, 2016, pp. 1-17, Taylor & Francis.
Linear Rolling Bearings ME EN 7960—Precision Machine Design Topic 8, Presentation, Accessed on Jan. 26, 2020, 23 Pages, University of Utah.
Linear-motion Bearing, Wikipedia, https://en.wikipedia.org/w/index.php?title=Linear-motion_bearing&oldid=933640111, Jan. 2, 2020, 4 Pages.
Machinery's Handbook 30th Edition, Copyright Page and Coefficients of Friction Page, 2016, Page 158 (2 pages total) Industrial Press, Inc, South Norwalk, U.S A.
Machinery's Handbook, 2016, Industrial Press, Inc., 30th edition, pp. 843 and 1055 (6 pages total).
McCarthy, J. Michael; Cam and Follower Systems, PowerPoint Presentation, Jul. 25, 2009, pp. 1-14, UCIrvine The Henry Samueli School of Engineering.
McGill Cam Follower Bearings brochure, 2005, p. 1-19, Back Page, Brochure MCCF-05, Form #8991 (20 pages total).
Motion & Control NSK Cam Followers (Stud Type Track Rollers) Roller Followers (Yoke Type Track Rollers) catalog, 1991, Cover Page, pp. 1-18, Back Page, CAT. No. E1421 2004 C-11, Japan.
Product Catalogue, Asahi Diamond Industrial Australia Pty. Ltd., accessed on Jun. 23, 2018, Cover Page, Blank Page, 2 Notes Pages, Table of Contents, pp. 1-49 (54 Pages total).
RBC Aerospace Bearings Rolling Element Bearings catalog, 2008, Cover Page, First Page, pp. 1-149, Back Page (152 Pages total).
RGPBalls Ball Transfer Units catalog, accessed on Jun. 23, 2018, pp. 1-26, 2 Back Pages (28 Pages total).
Sandvik Coromant Hard part turning with CBN catalog, 2012, pp. 1-42, 2 Back Pages (44 Pages total).
Sexton, Timothy N.; Cooley, Craig H.; Diamond Bearing Technology for Deep and Geothermal Drilling, PowerPoint Presentation, 2010, 16 Pages.
SKF Ball transfer units catalog, Dec. 2006, Cover Page, Table of Contents, pp. 1-36, 2 Back Pages (40 Pages total), Publication 940-711.
Sowers, Jason Michael, Examination of the Material Removal Rate in Lapping Polycrystalline Diamond Compacts, A Thesis, Aug. 2011, 2 Cover Pages, pp. iii-xiv, pp. 1-87 (101 Pages total).
Sun, Liling; Wu, Qi; Dai, Daoyang; Zhang, Jun; Qin, Zhicheng; Wang, Wenkui; Non-metallic catalysts for diamond synthesis under high pressure and high temperature, Science in China (Series A), Aug. 1999, pp. 834-841, vol. 42 No. 8, China.
Superhard Material, Wikipedia, https://en.wikipedia.org/wiki/Superhard_material, Retrieved from https://en.wikipedia.org/w/index.php?title=Superhard_material&oldid=928571597, Nov. 30, 2019, 14 pages.
Surface Finish, Wikipedia, https://en.wikipedia.org/wiki/Surface_finish, Retrieved from https://en.wikipedia.org/w/index.php?title=Surface_finish&oldid=919232937, Oct. 2, 2019, 3 pages.
United States Defensive Publication No. T102,901, published Apr. 5, 1983, in U.S. Appl. No. 298,271 [2 Pages].
USSynthetic Bearings and Waukesha Bearings brochure for Diamond Tilting Pad Thrust Bearings, 2015, 2 Pages.
USSynthetic Bearings brochure, accessed on Jun. 23, 2018, 12 Pages, Orem, Utah.
Zeidan, Fouad Y.; Paquette, Donald J., Application of High Speed and High Performance Fluid Film Bearings in Rotating Machinery, 1994, pp. 209-234.
Zhigadlo, N. D., Spontaneous growth of diamond from MnNi solvent-catalyst using opposed anvil-type high-pressure apparatus, accessed on Jun. 28, 2018, pp. 1-12, Laboratory for Solid State Physics, Switzerland.
Zou, Lai; Huang, Yun; Zhou, Ming; Xiao, Guijian; Thermochemical Wear of Single Crystal Diamond Catalyzed by Ferrous Materials at Elevated Temperature, Crystals, 2017, pp. 1-10, vol. 7.

SUCKER ROD COUPLINGS AND TOOL JOINTS WITH POLYCRYSTALLINE DIAMOND ELEMENTS

CROSS-REFERENCE TO RELATED APPLICATIONS

The present application claims the benefit of U.S. Provisional Patent Application No. 63/083,252, filed on Sep. 25, 2020, entitled "Sucker Rod Couplings with Polycrystalline Diamond Elements", the entirety of which is incorporated herein by reference. The present application is also a Continuation-in-Part of U.S. patent application Ser. No. 16/529,310 (pending), filed on Aug. 1, 2019, entitled "Polycrystalline Diamond Tubular Protection" which itself claims the benefit of U.S. Provisional Patent Application No. 62/713,681, filed on Aug. 2, 2018, entitled "Polycrystalline Diamond Tubular Protection," the entireties of which are incorporated herein by reference.

FIELD

The present disclosure relates to polycrystalline diamond elements for use as protection between tubulars that are movably engaged with one another; to apparatus and systems including the same; and to methods of making, assembling, and using the same.

BACKGROUND

Several downhole oil well construction and production applications involve relatively smaller diameter tubulars movably coupled (e.g., in sliding, rotating, and/or reciprocating engagement) with (e.g., inside) relatively larger diameter tubulars. These applications include, but are not limited to, a drill pipe string operating inside casing and a sucker rod string operating inside production tubing.

Wear on the internal diameter of the relatively larger, outer tubular and on the outer diameter of the relatively smaller, inner tubular, especially at the upset coupling or connection diameters of the inner pipe or sucker rod, is frequently problematic. These wear problems are accelerated in directionally drilled wells where gravity causes the inner tubular and its connections to engage with and "ride" on the inner, low-side of the larger diameter tubular (e.g., casing or production tubing). Additionally, wells with relatively high deviation changes create rub points for the interface of the inner and outer tubulars.

In drilling operations, such wear can lead to failed drill string and loss of the drill string below the failure. Such wear can also cause problems to the integrity of the well due to casing wear. In production operations, such wear can lead to failure of the sucker rod string or cause wear of the production tubing. A production tubing failure causes the operator to have to prematurely service the well, adding cost and losing production.

Over time, technology has been developed to reduce the contact and wear at the interface of the inner and outer tubulars by attaching sacrificial protectors or guides at intervals around the outer surface of the inner tubular string. In drilling applications, these sacrificial protectors or guides are typically referred to as "pipe protectors." In production applications, these sacrificial protectors or guides are typically referred to as "rod guides." In both drilling and production applications, these sacrificial protectors or guides are typically made from molded rubber, nylon, plastic, polymer, polyurethane, synthetic polyamide, or polyether ether ketone (PEEK). Pipe protectors are typically mounted on a metal frame. Rod guides may be molded directly onto the rod lengths and may or may not include a metal frame. With any of the materials currently used for sacrificial protectors or guides, relatively higher temperatures result in an increase in the rate of abrasive wear of the sacrificial protectors or guides.

Replacing drill pipe, sucker rod strings, and/or production tubing is expensive and time consuming. In the case of production applications, the avoidance of wear problems involves working over the well to replace guides and clear debris from the production tubing. In so called unconventional wells, the frequency of workovers to replace sucker rod guides can be as often as every three months.

What is needed is a technology to extend the lifespan of pipe protectors and rod guides without increasing or significantly increasing the coefficient of friction of the engagement of the protectors/guides with the outer tubulars.

Polycrystalline diamond elements have, in the past, been contraindicated for engagement with the inner surfaces of casing or production tubing. Without being bound by theory, polycrystalline diamond, including thermally stable polycrystalline diamond and polycrystalline diamond compact, has been considered as contraindicated for use in the engagement with ferrous metals, and other metals, metal alloys, composites, hardfacings, coatings, or platings that contain more than trace amounts of diamond solvent-catalyst including cobalt, nickel, ruthenium, rhodium, palladium, chromium, manganese, copper, titanium, or tantalum. Further, this prior contraindication of the use of polycrystalline diamond extends to so called "superalloys" including iron-based, cobalt-based and nickel-based superalloys containing more than trace amounts of diamond solvent-catalyst. The surface speeds typically used in machining of such materials typically ranges from about 0.2 m/s to about 5 m/s. Although these surface speeds are not particularly high, the load and attendant temperature generated, such as at a cutting tip, often exceeds the graphitization temperature of diamond (i.e., about 700° C.), which can, in the presence of diamond solvent-catalyst, lead to rapid wear and failure of components, such as diamond tipped tools. Without being bound by theory, the specific failure mechanism is believed to result from the chemical interaction of the carbon bearing diamond with the carbon attracting material that is being machined. An exemplary reference concerning the contraindication of polycrystalline diamond for diamond solvent-catalyst containing metal or alloy machining is U.S. Pat. No. 3,745,623. The contraindication of polycrystalline diamond for machining diamond solvent-catalyst containing materials has long caused the avoidance of the use of polycrystalline diamond in all contacting applications with such materials.

BRIEF SUMMARY

Some embodiments of the present disclosure include a sucker rod assembly. The assembly includes production tubing positioned within a wellbore. The production tubing has an internal cavity wall defining a cavity of the production tubing. The internal cavity wall is a metal surface including a metal that contains at least 2 wt. % of a diamond solvent-catalyst based on a total weight of the metal. A sucker rod string is positioned within the cavity of the production tubing. The sucker rod string includes a first sucker rod, a second sucker rod, and a sucker rod coupler. The first sucker rod is coupled with a first end of the sucker rod coupler, and the second sucker rod is coupled with a second end of the sucker rod coupler. A plurality of polycrystalline diamond elements are coupled with the sucker rod coupler. Each polycrystalline diamond element has an engagement surface of polycrystalline diamond. The engagement surfaces of polycrystalline diamond are positioned along the sucker rod string to interface engagement between the sucker rod string and the metal surface of the production tubing.

Some embodiments of the present disclosure include a method of interfacing engagement between a sucker rod string and production tubing. The method includes providing a sucker rod string having a first sucker rod, a second sucker rod, and a sucker rod coupler. The first sucker rod is coupled with a first end of the sucker rod coupler, and the second sucker rod is coupled with a second end of the sucker rod coupler. The method includes positioning a plurality of polycrystalline diamond elements on the sucker rod coupler. Each polycrystalline diamond element has an engagement surface of polycrystalline diamond. The method includes providing production tubing positioned within a wellbore. The production tubing has an internal cavity wall defining a cavity. The internal cavity wall is a metal surface including a metal that contains at least 2 wt. % of a diamond solvent-catalyst based on a total weight of the metal. The method includes positioning the sucker rod string within the cavity of the production tubing such that the engagement surfaces of polycrystalline diamond are positioned along the sucker rod string to interface engagement between the sucker rod string and the metal surface of the production tubing.

Some embodiments of the present disclosure include a downhole tubular assembly. The assembly includes a tubular having a first end, a second end, and a tool joint at the second end. A plurality of polycrystalline diamond elements are coupled with the tool joint. Each polycrystalline diamond element has an engagement surface of polycrystalline diamond. The assembly includes casing in a wellbore. The casing has an internal wall having a metal surface. The metal surface includes a metal that contains at least 2 wt. % of a diamond solvent-catalyst based on a total weight of the metal. The tubular is positioned within the casing such that the engagement surfaces of the polycrystalline diamond are positioned to interface engagement between the tool joint and the internal wall of the casing.

Some embodiments of the present disclosure include a method of interfacing engagement between a tool joint and casing. The method includes providing a tubular having a first end, a second end, and a tool joint at the second end. The method includes coupling a plurality of polycrystalline diamond elements with the tool joint. Each polycrystalline diamond element has an engagement surface of polycrystalline diamond. The method includes providing casing in a wellbore. The casing has an internal wall having a metal surface. The metal surface includes a metal that contains at least 2 wt. % of a diamond solvent-catalyst based on a total weight of the metal. The method includes positioning the tubular in the casing such that the engagement surfaces of the polycrystalline diamond are positioned to interface engagement between the tool joint and the internal wall of the casing.

BRIEF DESCRIPTION OF THE DRAWINGS

So that the manner in which the features and advantages of the systems, apparatus, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

DETAILED DESCRIPTION

Certain embodiments of the present disclosure include polycrystalline diamond elements for use as protection between tubulars that are movably engaged with one another, protectors or guides including the polycrystalline diamond elements; tubular assemblies including the protectors or guides, apparatus and systems including the tubular assemblies; and to methods of making, assembling, and using the polycrystalline diamond elements, the protectors or guides, the tubular assemblies, and the apparatus and systems.

Engagement Interface

Certain embodiments of the present disclosure include an engagement interface configured to interface the engagement of two different tubulars. With reference to FIGS. 1A-1D, exemplary engagement interfaces are depicted. Engagement interface 10 includes body 12. Body 12 may be or include a material such as metal, such as steel, or a polymer, such as a rubber or a plastic. Some exemplary polymers of which body 12 may be or include are nylon, polyurethane, polyamide (e.g., synthetic polyamide), or polyether ether ketone (PEEK). Body 12 is not limited to being or including any of these particular materials.

Figure 1A:
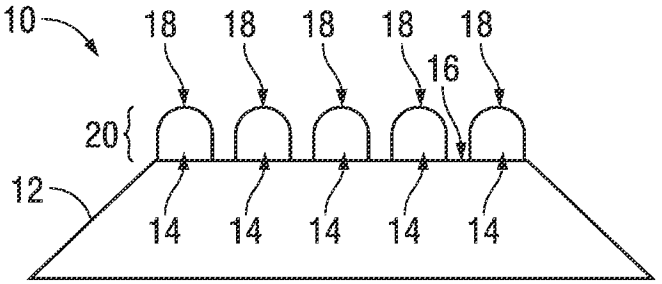
FIG. 1A is a side view of a tubular engagement interface including polycrystalline diamond elements extending above an engagement surface of a body of the tubular engagement interface.
Figure 1B:
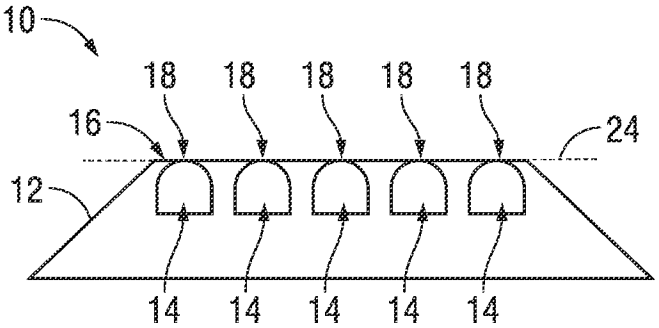
FIG. 1B is a side view of a tubular engagement interface including polycrystalline diamond elements that are flush with an engagement surface of a body of the tubular engagement interface.
Figure 1C:
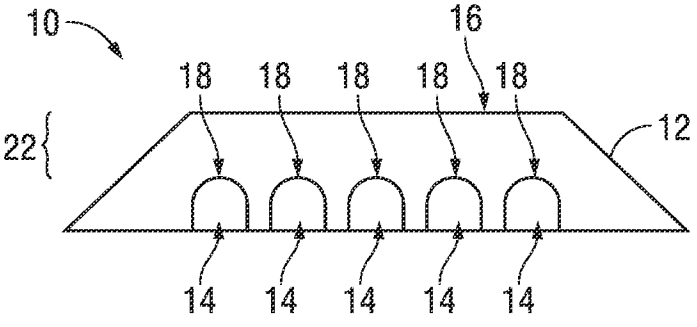
FIG. 1C is a side view of a tubular engagement interface including polycrystalline diamond elements positioned below an engagement surface of a body of the tubular engagement interface.
Figure 1D:
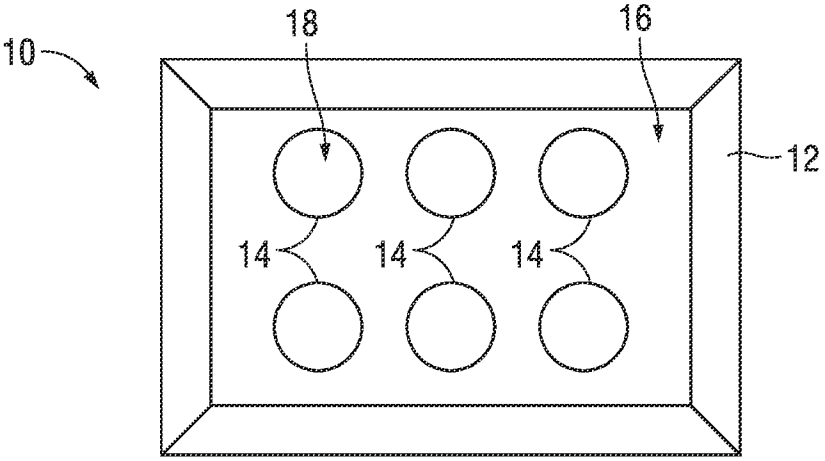
FIG. 1D is a top view of a tubular engagement interface including polycrystalline diamond elements.

Engagement interface 10 includes a plurality of polycrystalline diamond elements 14. Each polycrystalline diamond element 14 is coupled with body 12. For example, each polycrystalline diamond element 14 may be embedded within body 12 or otherwise coupled to body 12. In embodiments where body 12 is a polymer body, body 12 may be molded onto, over, or with polycrystalline diamond elements 14 via a polymer molding process. For example, FIGS. 1B and 1C show variations of polycrystalline diamond elements 14 embedded into body 12, with body 12 molded over polycrystalline diamond elements 14. In embodiments where body 12 is a metal body, polycrystalline diamond elements 14 may be attached to body 12, such as attached onto the surface of body 12 or attached within a machined recess in body 12. For example, FIG. 1A shows polycrystalline diamond elements 14 attached on top of body 12. In some embodiments, polycrystalline diamond elements 14 are static relative to body 12.

Body 12 includes body engagement surface 16, and each polycrystalline diamond element 14 includes a diamond engagement surface 18. As shown in FIG. 1A, in some embodiments polycrystalline diamond elements 14 extend above body engagement surface 16, such that diamond engagement surfaces 18 are positioned above body engagement surface 16 by first distance 20. In other embodiments, as shown in FIG. 1B, diamond engagement surfaces 18 are flush with body engagement surface 16, such that diamond engagement surfaces 18 lie in the same plane 24 as (i.e., are coplanar with) body engagement surface 16. In still other embodiments, as shown in FIG. 1C, body engagement surface 16 extends above diamond engagement surfaces 18, such that body engagement surface 16 is positioned above each of diamond engagement surfaces 18 by second distance 22. As used herein, "engagement surface" refers to the surface of a material (e.g., polycrystalline diamond or polymer or steel) that is positioned and arranged within an assembly (e.g., within a tubular assembly) such that, in operation of the assembly, the engagement surface interfaces contact between two tubulars of the tubular assembly. It would be understood by one skilled in the art that the diamond engagement surface and/or body engagement surface are not limited to being necessarily in constant engagement with the opposing engagement surface. Rather, the diamond engagement surface and/or body engagement surface are positioned such that one or both of the diamond engagement surface and/or body engagement surface will engage with the opposing engagement surface prior to direct, surface-to-surface engagement between the two tubulars.

Engagement interface 10 may provide protection at the interface of two different tubulars that are movably (e.g., slidingly and/or rotatably) engaged with one another. In some embodiments, engagement interface 10 is a drill pipe protector. In other embodiments, engagement interface 10 is a sucker rod guide. While shown and described herein as a drill pipe protector and a sucker rod guide, the engagement interface disclosed herein is not limited to being a drill pipe protector or a sucker rod guide, and may be another structure that is capable of being coupled with a tubular and interfacing movable engagement between that tubular and another tubular. In some embodiments, rather than being coupled with a tubular, the engagement interface is integral with the tubular. In some embodiments, the engagement interface is static relative to one tubular (i.e., the tubular to which the engagement interface is coupled), and is movable relative to the other tubular (i.e., is movably engaged with the other tubular).

Tubular Assemblies

Certain embodiments include tubular assemblies that include the engagement interfaces disclosed herein positioned to interface the engagement between the tubulars of the tubular assemblies. With reference to FIGS. 2A-2F, a first tubular and a second tubular are shown. The first and second tubulars may be, for example and without limitation, piping, casing, rods, tubing, downhole tools, or other tubulars.

Tubular 30 is a hollow tubular having inner wall 32 defining cavity 34 therethrough, such as a pipe or other conduit. Tubular 30 has outer wall 36. Tubular 30 has an outer diameter 38 defined by outer wall 36, and an inner diameter 31 defined by inner wall 32.

Figure 2F:
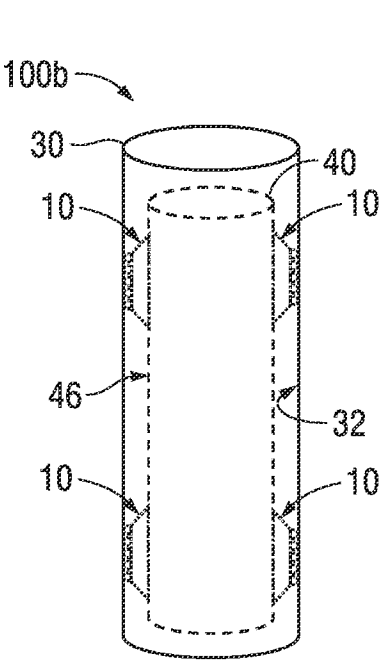
FIG. 2F is a perspective view of a relatively smaller diameter tubular movably engaged within a relatively larger diameter tubular, with a tubular engagement interface coupled on the relatively smaller diameter tubular and interfacing the engagement therebetween.
Figure 2E:
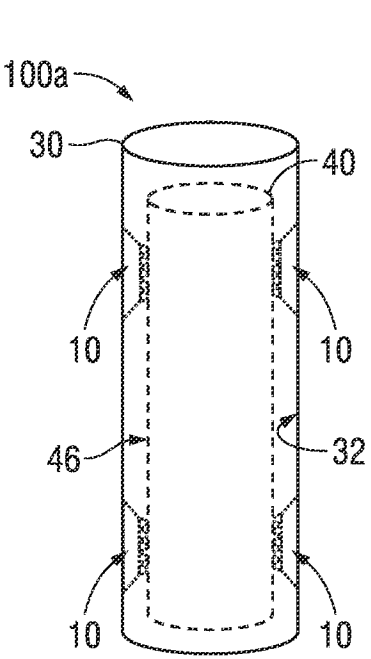
FIG. 2E is a perspective view of a relatively smaller diameter tubular movably engaged within a relative larger diameter tubular, with a tubular engagement interface coupled on the relatively larger diameter tubular and interfacing the engagement therebetween.
Figure 2D:
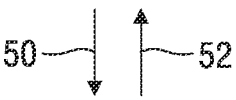
FIG. 2D is a perspective view of a solid tubular.
Figure 2D:
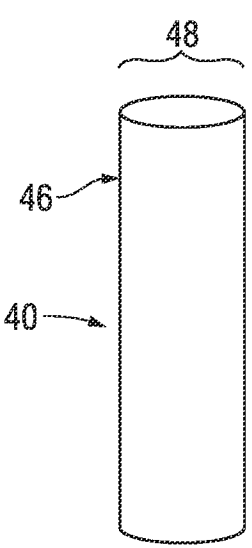
Figure 2C:
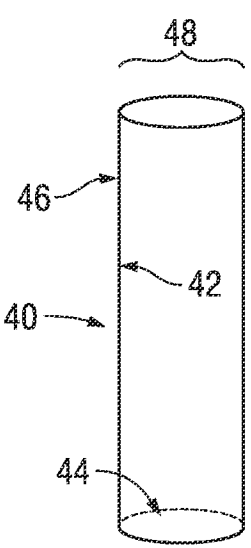
FIG. 2C is a perspective view of a hollow tubular having a smaller diameter than that of FIG. 2A.

In some embodiments, as shown in FIG. 2C, tubular 40 is a hollow tubular, such as a pipe or other conduit, having inner wall 42 defining cavity 44 therethrough. In other embodiments, as shown in FIG. 2D, tubular 40 is a solid tubular, such as rod, without a cavity or conduit defined therethrough. Tubular 40 has an outer wall 46, defining outer diameter 48 of tubular 40.

Outer diameter 48 of tubular 40 and inner diameter 31 of tubular 30 are sized such that tubular 40 may be coupled or engaged at least partially within cavity 34 of tubular 30, as shown in FIG. 2E. That is, tubular 30 is a relatively larger diameter tubular, and tubular 40 is a relatively smaller diameter tubular, such that outer diameter 48 of tubular 40 is smaller than inner diameter 31 of tubular 30.

As shown in FIGS. 2E and 2F, tubular assemblies 100*a* and 100*b* each include tubulars 30 and 40, which are movably engaged with one another. Tubular 40 is slidingly engaged within tubular 30 such that one or both of tubulars 30 and 40 are movable along one or both directions 50 and 52. As used herein, "slidingly engaged" refers to an engagement between at least two tubulars that allows at least one of the tubulars to slide relative to the other of the tubulars. For example, tubular 40 may slide within tubular 30 along one or both directions 50 and 52, tubular 30 may slide about tubular 40 along one or both directions 50 and 52, or combinations thereof.

Figure 2A:
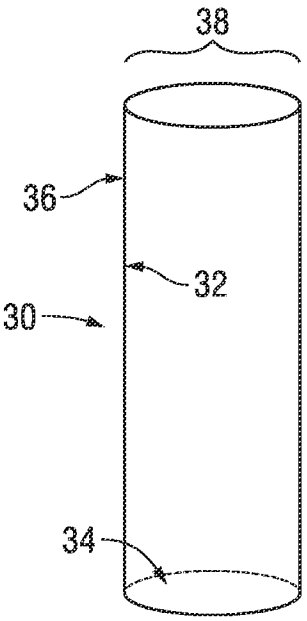
FIG. 2A is a perspective view of a hollow tubular.
Figure 2B:
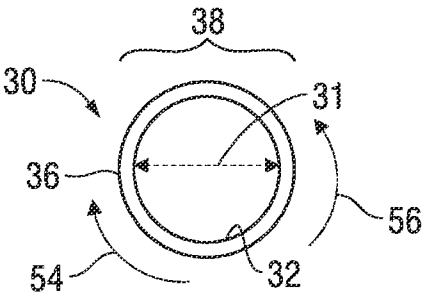
FIG. 2B is an end view of the hollow tubular of FIG. 2A.

Tubular 40 is rotatably engaged within tubular 30 such that one or both of tubulars 30 and 40 are rotatable in one or both directions 54 and 56 (as shown in FIG. 2B). As used herein, "rotatably engaged" refers to an engagement between at least two tubulars that allows at least one of the tubulars to rotate relative to the other of the tubulars. For example, tubular 40 may rotate within tubular 30 along one or both directions 54 and 56, tubular 30 may rotate about tubular 40 along one or both directions 54 and 56, or combinations thereof.

Thus, tubular 40 is movably engaged within tubular 30 such that one or both of tubulars 30 and 40 are movable relative to the other tubular. As used herein, "movably engaged," in reference to engaged tubulars, refers to an engagement between at least two tubulars that allows at least one of the tubulars to move relative to the other of the tubulars. For example, tubular 40 may move (e.g., slide and/or rotate) relative to tubular 30, tubular 30 may move relative to tubular 40, or combinations thereof.

Engagement interfaces 10 may be positioned on and coupled with the larger diameter tubular for interfacing engagement thereof with the smaller diameter tubular, or engagement interfaces 10 may be positioned on and coupled with the smaller diameter tubular for interfacing engagement thereof with the larger diameter tubular. In FIG. 2E, engagement interfaces 10 are positioned on and coupled with tubular 30, and engaged with opposing engagement surface of tubular 40, i.e., outer wall 46. In FIG. 2F, engagement interfaces 10 are positioned on and coupled with tubular 40, and engaged with opposing engagement surface of tubular 30, i.e., inner wall 32.

As used herein, "opposing tubular" refers to a tubular that is movably engaged with a different tubular, where the different tubular has at least one of the engagement interfaces coupled thereon to interface engagement with the opposing tubular.

Mounting of Polycrystalline Diamond Elements and Wear Characteristics

Figure 3D:
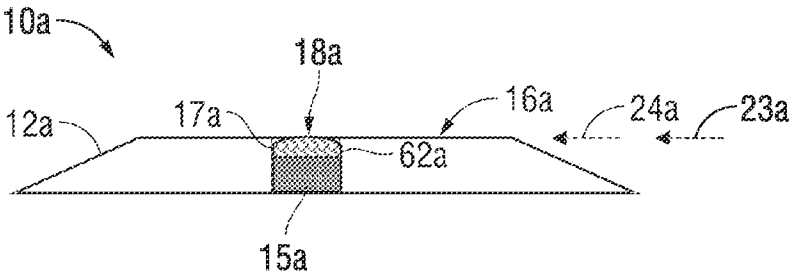
FIG. 3D is a side view of the tubular engagement interface of FIG. 3A, after the occurrence of wear.
Figure 3B:
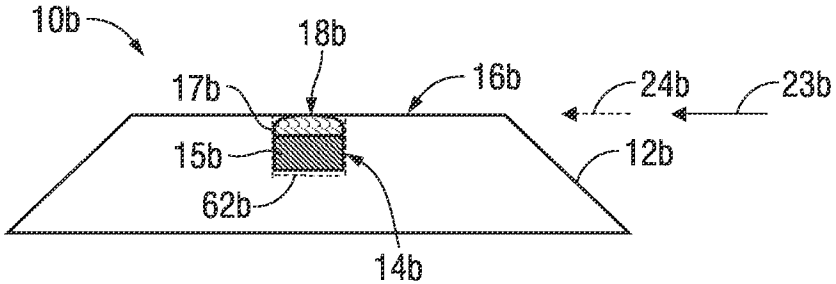
FIG. 3B is a side view of a tubular engagement interface including polycrystalline diamond elements that are flush with an engagement surface of a body of the tubular engagement interface, with the polycrystalline diamond elements positioned within a socket in the body.
Figure 3A:
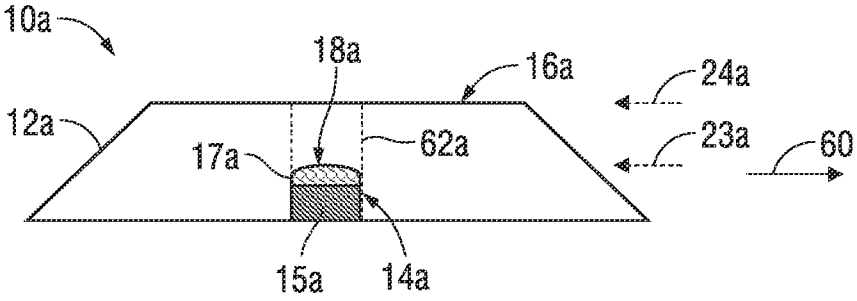
FIG. 3A is a side view of a tubular engagement interface including polycrystalline diamond elements positioned below an engagement surface of a body of the tubular engagement interface, prior to the occurrence of wear.
Figure 3C:
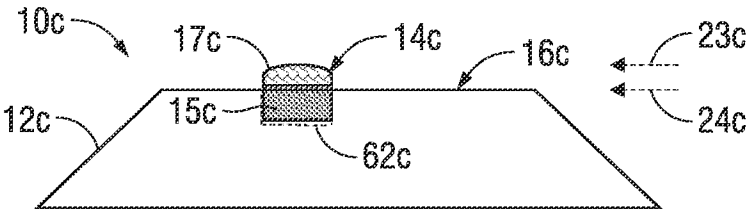
FIG. 3C is a side view of a tubular engagement interface including polycrystalline diamond elements extending above an engagement surface of a body of the tubular engagement interface, with the polycrystalline diamond elements positioned within a socket in the body.

With reference to FIGS. 3A-3D, the mounting of the polycrystalline diamond elements is shown and described. Bodies 12*a*-12*c* of engagement interfaces 10*a*-10*c*, which each may be the body of, part of, attached to, or integral with a drill pipe protector or sucker rod guide, are depicted with three differently mounted polycrystalline diamond elements 14*a*, 14*b*, and 14*c*, as shown in FIGS. 3A, 3B and 3C, respectively.

Polycrystalline diamond element 14*a* is exemplary of an "underexposed" polycrystalline diamond element, such that the polycrystalline diamond element is positioned below plane 24*a* defined by body engagement surface 16*a*. Thus, in operation polycrystalline diamond element 14*a* will engage with another tubular after the body engagement surface 16*a* is worn down sufficiently to expose the diamond engagement surface 18*a* of the polycrystalline diamond element 14*a*, as shown in FIG. 3D, which depicts engagement interface 10*a* after the occurrence of wear, depicted in FIG. 3D as 60. Thus, in FIG. 3A, diamond engagement surface 18*a* is positioned within plane 23*a* and body engagement surface 16*a* is positioned within 24*a*, which is above plane 23*a* and, in operation, in closer proximity to an opposing tubular surface. However, after a sufficient amount of wear 60, body 12*a* is worn down to a degree that plane 24*a* is coplanar with plane 23*a*; or such that plane 24*a* is below plane 23*a* and, in operation, plane 23*a* is in equal or closer proximity to an opposing tubular surface.

Polycrystalline diamond element 14*b*, as shown in FIG. 3B, is exemplary of a "flush" mounted polycrystalline diamond element, such that diamond engagement surface 18*b* resides in plane 24*b* defined by body engagement surface 16*b* of body 12*b*. That is, the plane defined by diamond engagement surface 18*b*, plane 23*b*, is coplanar with the plane defined by body engagement surface 16*b*, plane 24*b*. Thus, in operation, polycrystalline diamond element 14*b* will engage with an opposing tubular simultaneously with the engagement between body engagement surface 16*b* and the opposing tubular.

Polycrystalline diamond element 14*c*, as shown in FIG. 3C, is exemplary of an "exposed" polycrystalline diamond element, such that the polycrystalline diamond element is positioned above plane 24*c* defined by body engagement surface 16*c* of body 12*c*, and within plane 23*c*. Thus, in operation, polycrystalline diamond element 14*c* will engage with an opposing tubular prior to engagement between body engagement surface 16*c* and the opposing tubular.

Thus, in some embodiments, the polycrystalline diamond elements disclosed herein provide "back-up wear resistance capability" to the associated engagement interface. As used herein, "back-up wear resistance capability" refers to the arrangement of the polycrystalline diamond elements relative to the body such that, the diamond engagement surfaces engage with an opposing tubular only after sufficient wear of the body has occurred (e.g., as shown in FIGS. 3A and 3D). In other embodiments, the polycrystalline diamond elements disclosed herein provide "concurrent wear resistance capability" to the associated engagement interface. As used herein, "concurrent wear resistance capability" refers to the arrangement of the polycrystalline diamond elements relative to the body such that, the diamond engagement surfaces engage with an opposing tubular upon engagement between the body and the opposing tubular, without requiring the occurrence of wear prior to engagement between the diamond engagement surfaces and the opposing tubular (e.g., as shown in FIG. 3B). In still other embodiments, the polycrystalline diamond elements disclosed herein provide "primary wear resistance capability" to the associated engagement interface. As used herein, "primary wear resistance capability" refers to the arrangement of the polycrystalline diamond elements relative to the body such that, the diamond engagement surfaces engage with an opposing tubular prior to engagement between the body and the opposing tubular, and without requiring the occurrence of wear prior to engagement between the diamond engagement surfaces and the opposing tubular (e.g., as shown in FIG. 3C). As such, polycrystalline diamond elements 14*a*, 14*b*, and 14*c* provide primary, concurrent, and back-up wear resistance capability to protectors for drill pipe or sucker rods, respectively. The engagement interfaces disclosed herein are not limited to including only one of exposed (FIGS. 1A and 3C), flush (FG. 1B and 3B, or recess (FIGS. 1C and 3A) mounted polycrystalline diamond elements, but may include any combination thereof.

As shown in FIGS. 3A-3D, polycrystalline diamond elements 14*a*-14*c* may be positioned in or coupled with or within sockets or cavities 62*a*-62*c* within bodies 12*a*-12*c*, respectively. Also, each polycrystalline diamond element 14*a*-14*c* includes support 15*a*-15*c*, respectively, and diamond layer 17*a*-17*c*, respectively. Diamond layers 17*a*-17*c* may be coupled with supports 15*a*-15*c*, and supports 15*a*-15*c* may be coupled with bodies 12*a*-12*c*, respectively. For example, diamond layers 17*a*-17*c* may be or include thermally stable polycrystalline diamond or PDC, and supports may be or include tungsten carbide. In some embodiments, the engagement interfaces disclosed herein include a plurality of polycrystalline diamond elements (e.g., PDCs), and each of the polycrystalline diamond elements is discrete from the other of the plurality of polycrystalline diamond elements.

Having described engagement interfaces, generally, certain embodiments and applications thereof will now be described in further detail.

Sucker Rod with Guide

In some embodiments, the engagement interfaces disclosed herein are provided on a sucker rod guide, such as for interfacing the engagement between a sucker rod string movably positioned within production tubing. For example, with reference to FIG. 2F, tubular 40 may be a sucker rod with engagement interfaces 10 forming at least a portion of a sucker rod guide thereon, and tubular 30 may be a production tubing within which the sucker rod is positioned. As would be understood by one skilled in the art, a sucker rod is a rod (e.g., a steel rod) that is used to make up the mechanical assembly between the surface and downhole components of a rod pumping system. Sucker rods may be from 20 to 40 feet, or from 24 to 35 feet, or from 25 to 30 feet in length, and may be threaded at each end to enable the downhole components to be run and retrieved easily. One skilled in the art would understand that sucker rods may be other lengths, depending on the particular application.

With reference to FIGS. 4A-4D, one exemplary sucker rod assembly 101*a* is depicted, including sucker rod 102 with sucker rod guide 104. Sucker rod 102 is engaged with sucker rod guide 104. In some embodiments, at least some portions of sucker rod guide 104 are molded directly onto sucker rod 102. For example, body 12 of sucker rod guide 104 may be or include a moldable material (e.g., a polymer), such as molded rubber, nylon, polyurethane, synthetic polyamide, polyether ether ketone (PEEK), or another plastic or elastomer. Such materials may be molded onto sucker rod 102 via any of various polymer molding techniques, such as extrusion molding. Sucker rod 102 may be or include a metal rod, such as a steel rod. Thus, in some embodiments, sucker rod guide 104 is coupled with sucker rod 102. In some such embodiments, sucker rod guide 104 is static, relative to sucker rod 102.

Body 12 of sucker rod guide 104 includes base 13 circumferentially surrounding sucker rod 102. Body 12 also includes protrusions 110 extending outward from base 13, away from sucker rod 102. In some embodiments, protrusions 110 are in the form of peaks, blades, ribs, fins, or vanes extending outward from sucker rod 102. Protrusions 110 are spaced radially about base 13 and sucker rod 102, such that cavities or valleys 111 are positioned between adjacent protrusions 110. Each protrusion 110 defines a body engagement surface 16 for engagement with, for example, production tubing to protect and/or guide sucker rod 102 during operation thereof.

Figure 4A:
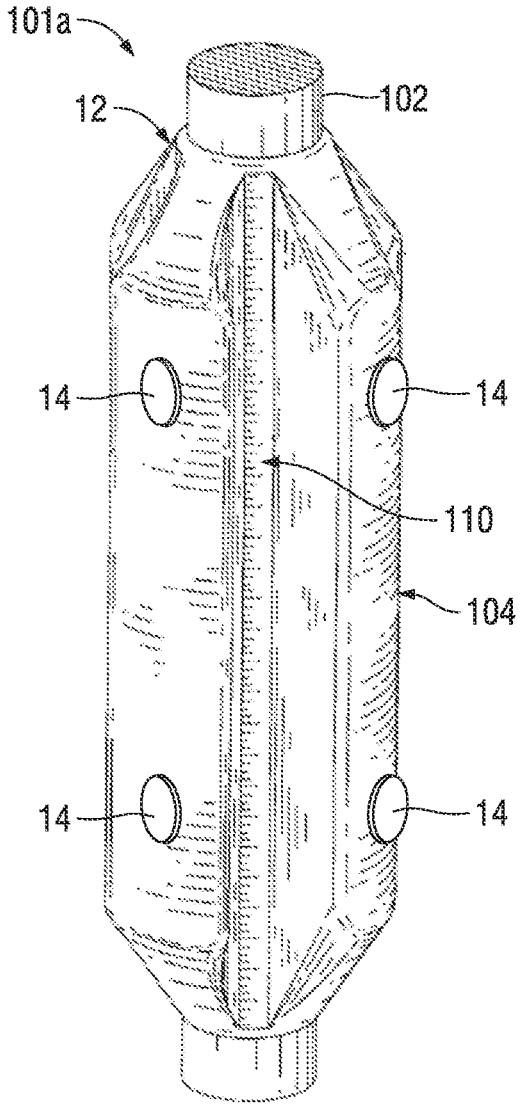
FIG. 4A is a perspective view of a sucker rod and sucker rod guide with polycrystalline diamond elements thereon.
Figure 4B:
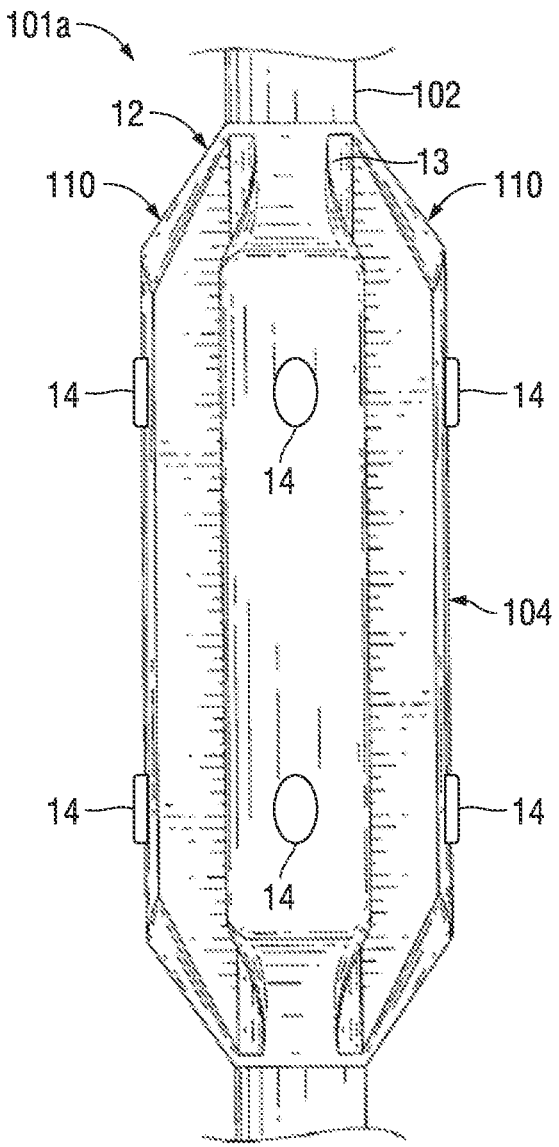
FIG. 4B is a side view of the sucker rod and sucker rod guide of FIG. 4A.
Figure 4C:
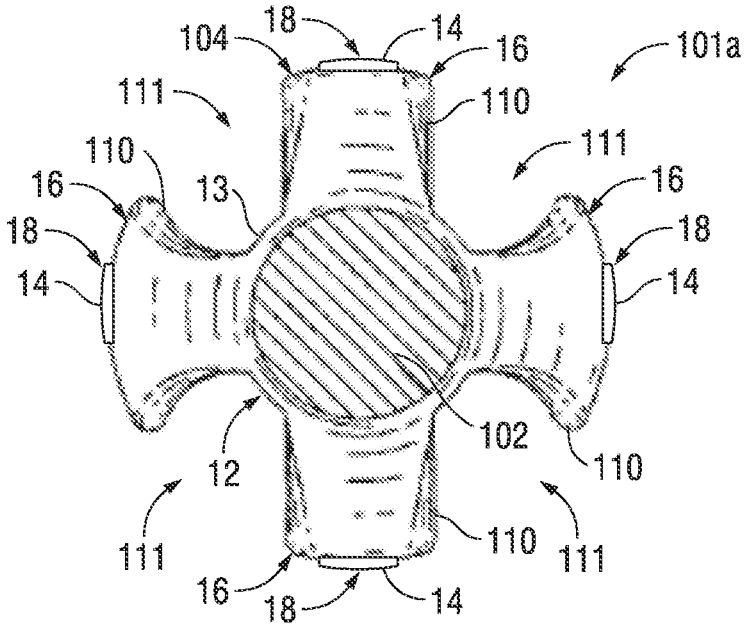
FIG. 4C is a top view of the sucker rod and sucker rod guide of FIG. 4A.

At least one polycrystalline diamond element is coupled with the sucker rod guides disclosed herein. As shown in FIG. 4A, sucker rod guide 104 includes four protrusions 110, each with two polycrystalline diamond elements 14 thereon. However, the sucker rod guides disclosed herein are not limited to having this number of protrusions or polycrystalline diamond elements, and may include any number of polycrystalline diamond elements arranged in any of various arrangements.

Each polycrystalline diamond element 14 may be embedded within body engagement surface 16 or otherwise attached to sucker rod guide 104, such that polycrystalline diamond elements 14 are positioned to protect and guide the engagement between sucker rod 102 and, for example, production tubing. As shown, polycrystalline diamond elements 14 have convex engagement surfaces 18 for engagement with production tubing and are in the form of inserts that are inserted into sucker rod guide 104. However, the polycrystalline diamond elements disclosed herein are not limited to this particular arrangement, shape, or number.

Figure 4D:
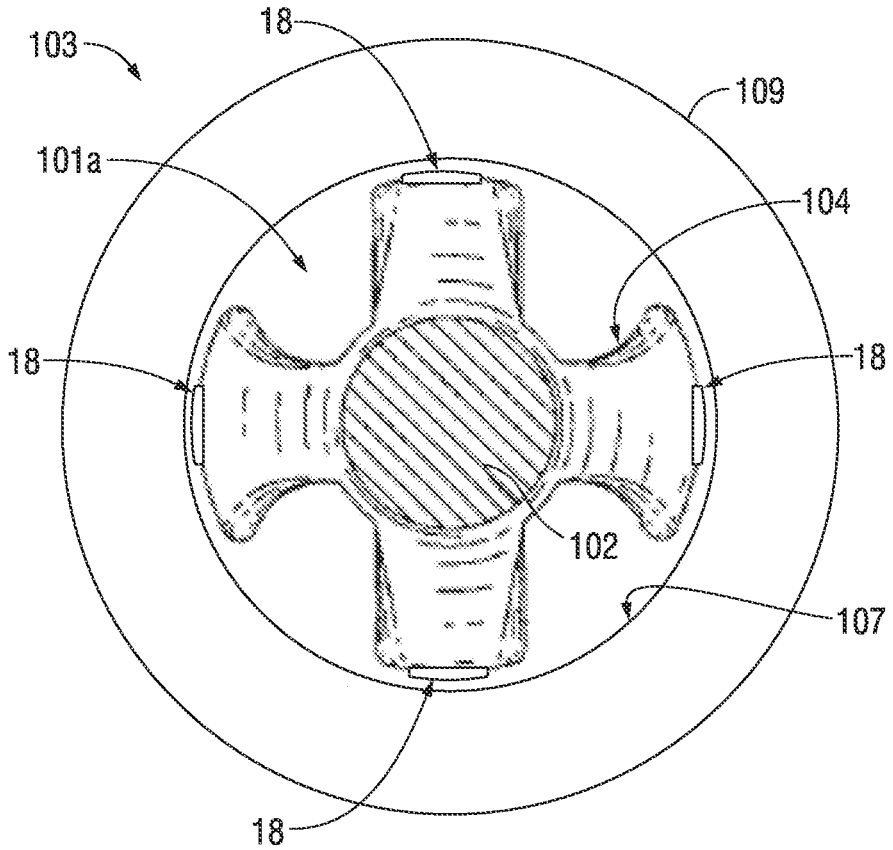
FIG. 4D is a top view of the sucker rod and sucker rod guide of FIG. 4A positioned within production tubing.

FIG. 4D depicts tubular assembly 103, including sucker rod 102 and sucker rod guide 104, engaged within production tubing 109. As shown, diamond engagement surfaces 18 interface engagement between sucker rod 102 and inner surface o of production tubing 109.

Figure 5:
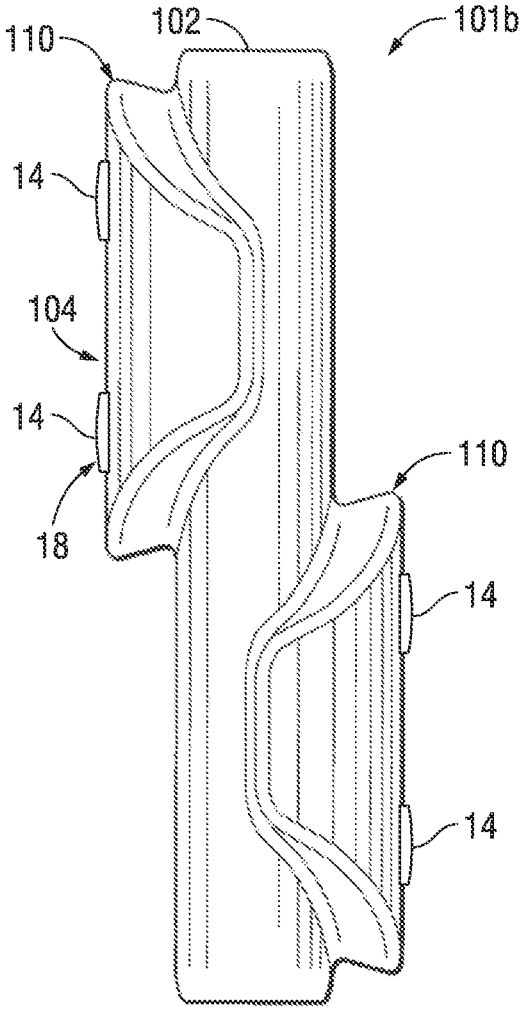
FIG. 5 is a side view of another sucker rod guide with polycrystalline diamond elements thereon.

FIG. 5 depicts another embodiment of a sucker rod assembly 101*b*, including sucker rod 102 and sucker rod guide 104, with like reference numerals indicating like elements. Sucker rod 102 is engaged with sucker rod guide 104, which includes protrusions 110, each having convex polycrystalline diamond elements 14 inserted therein. The difference between FIGS. 4A-4D and FIG. 5 is in the form, shape, arrangement, and positioning of sucker rod guide 104. Thus, in FIGS. 4A-4D and 5, the tubular engagement interface disclosed herein, including body 12 and polycrystalline diamond elements 14, are in the form of, or form a portion of, a sucker rod guide.

In some embodiments, the sucker rod guide disclosed herein (e.g., the sucker rod guide of FIGS. 4A-4D) is a sucker rod guide the same or similar as described in FIGS. 1-6 of U.S. Pat. No. 6,152,223, with the addition of the polycrystalline diamond elements described herein.

Drill Pipe

In some embodiments, the engagement interfaces disclosed herein are provided on a pipe protector of a pipe (e.g., a drill pipe), such as for interfacing the engagement between a drill pipe and casing during drilling operations where the drill pipe is movably positioned within the casing. For example, with reference to FIG. 2F, tubular 40 may be a drill pipe with engagement interfaces 10 forming at least a portion of a pipe protector thereon, and tubular 30 may be casing within which the drill pipe is positioned.

Figure 6:
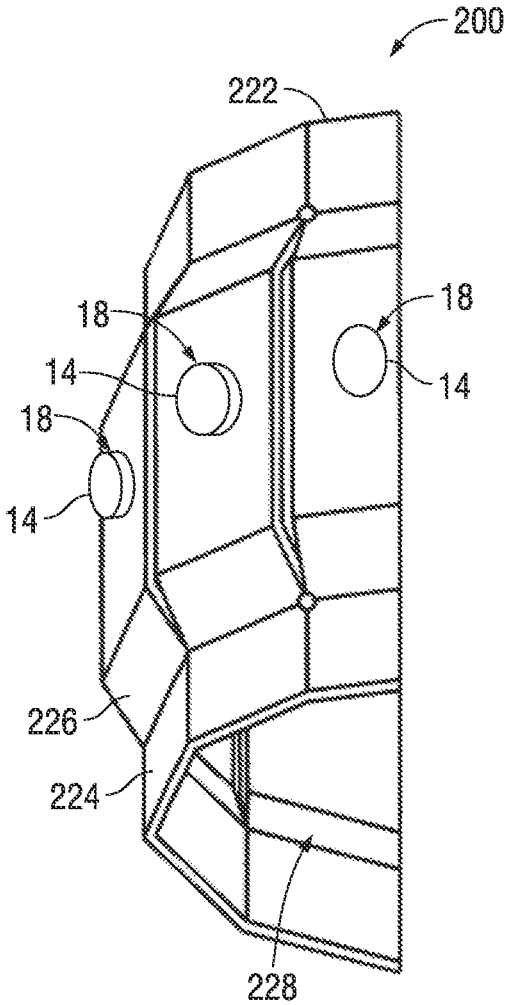
FIG. 6 is a partial, perspective view of a drill pipe protector frame having polycrystalline diamond elements thereon.
Figure 8:
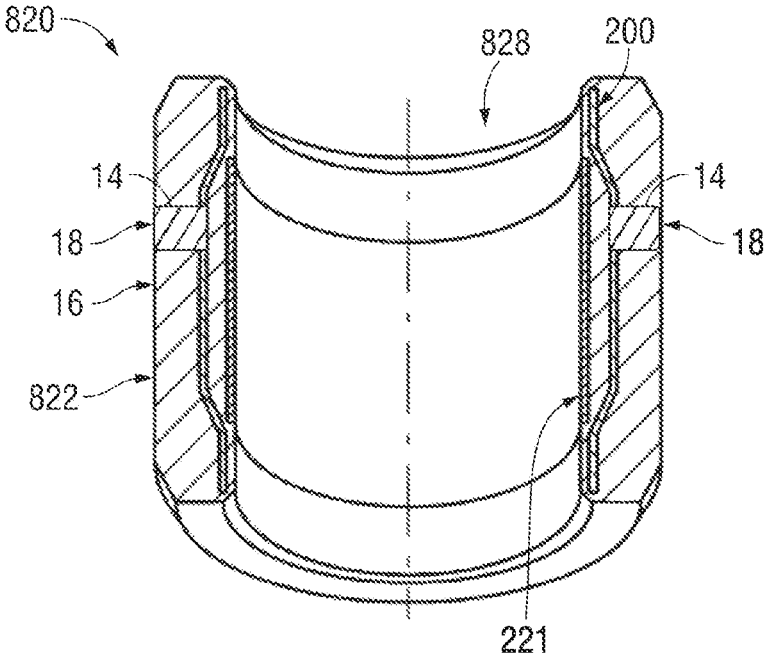
FIG. 8 is a cross-sectional view of a drill pipe protector having polycrystalline diamond elements thereon.

With reference to FIGS. 6 and 8, one drill pipe protector in accordance with the present disclosure will be described. In some embodiments, the drill pipe protector disclosed is in accordance with the pipe protector shown and described in U.S. Pat. No. 5,833,019, such as in FIGS. 1, 2 and 4 of U.S. Pat. No. 5,833,019, with the addition of the polycrystalline diamond elements disclosed herein incorporated into the pipe protector.

Drill pipe protector 820 includes body 822, also referred to as a sleeve, which defines a portion of the wear surface or body engagement surface 16. Embedded within body 822 is frame 200, forming cage 222, as shown in FIG. 6. Also, inner frame 221 may be embedded within body 822. Polycrystalline diamond elements 14 may be coupled with frame 222, such that polycrystalline diamond elements 14 are also embedded at least partially within body 822. Polycrystalline diamond elements 14 may be embedded within body such that engagement surface 18 is flush with body engagement surface 16, is recessed relative to body engagement surface 16, or extends above body engagement surface 16.

With reference to FIG. 6, frame 200 includes frame body 224 and protrusions 226. Protrusions 226 extend outward from frame body 224. Attached to, embedded within, inserted within, or otherwise coupled with protrusions 226 are polycrystalline diamond elements 14, which are positioned to engage with, for example, casing during drilling operations. Frame 200 includes cavity 228, which is at least partially defined by frame body 224. With reference to FIG. 8, a cross-sectional view of drill pipe protector 820, frame 200 is embedded within body 822. Polycrystalline diamond elements 14 are positioned to engage with, for example, casing during drilling operations. Drill pipe may be positioned within opening 828, such that body 822 and drill pipe protector frame 200 are positioned about drill pipe, and between drill pipe and casing. For example, drill pipe protector 820 may be arranged about a drill pipe in the same or substantially the same way as drill pipe protector 722, as shown in FIGS. 7A-7C.

Figure 7A:
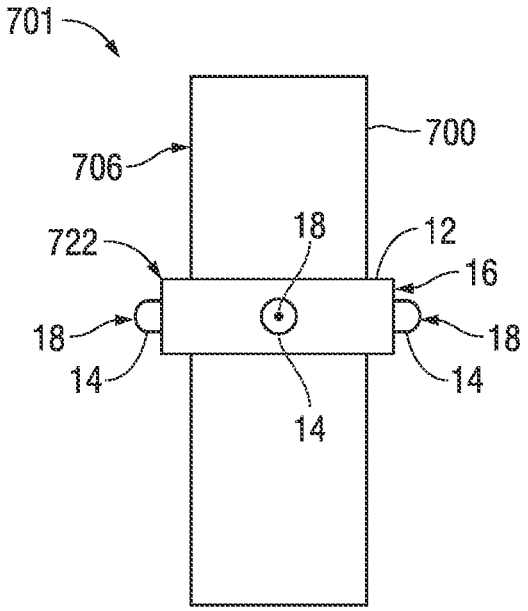
FIG. 7A is a side view of a pipe protector, including polycrystalline diamond elements thereon, on a drill pipe.
Figure 7B:
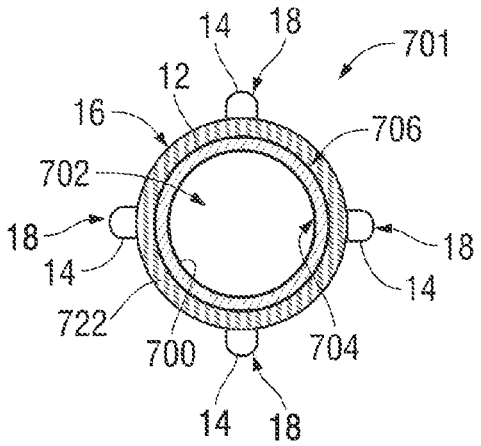
FIG. 7B is an end view of the pipe protector and drill pipe of FIG. 7A.
Figure 7C:
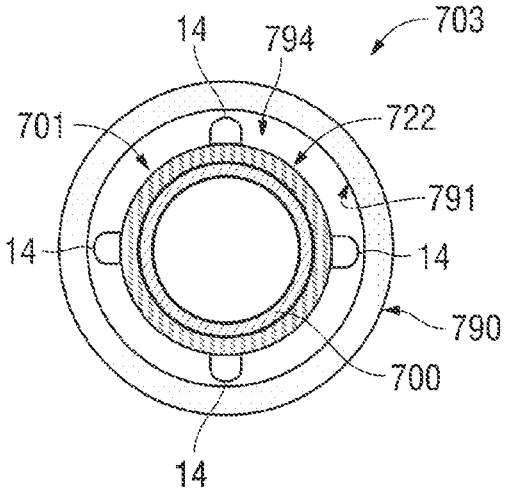
FIG. 7C is an end view of the pipe protector and drill pipe of FIG. 7A, positioned within a wellbore casing.

FIG. 7A depicts a side view of tubular assembly 701, including drill pipe 700 with drill pipe protector 722 coupled thereabout, including polycrystalline diamond elements 14. FIG. 7B depicts a top view of drill pipe 700 and drill pipe protector 722, showing cavity 702 of drill pipe 700 defined by inner surface 704 of drill pipe 700, and drill pipe protector 722 coupled about outer surface 706 of drill pipe 700. FIG. 7C depicts a top view of assembly 703, including tubular assembly 701 positioned within casing 790. As shown, drill pipe 700 and drill pipe protector 722 are positioned within cavity 794 of casing 790. Polycrystalline diamond elements 14 interface any engagement that may occur between drill pipe 700 and inner wall 791 of casing 790 during operation.

Figure 9:
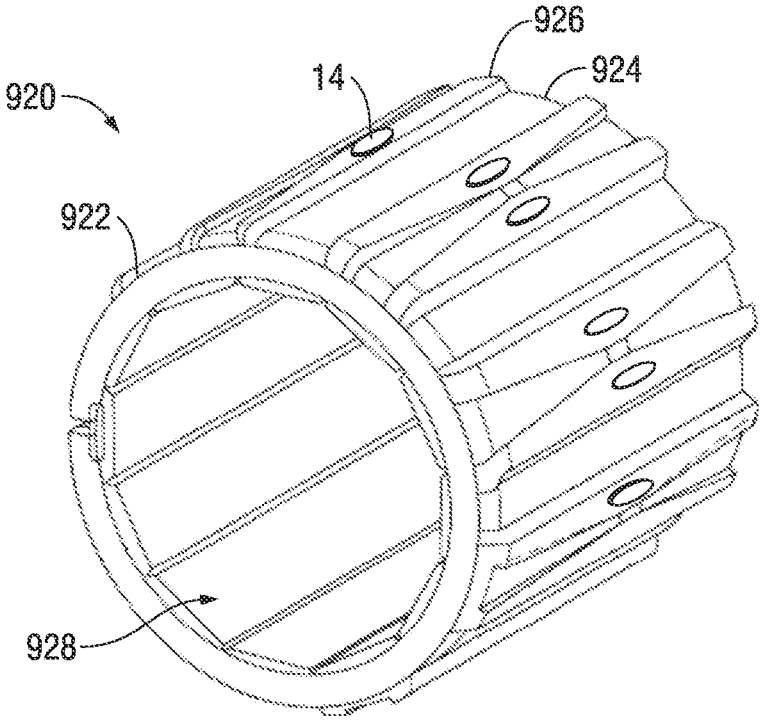
FIG. 9 is another perspective view of a drill pipe protector having polycrystalline diamond elements thereon.

With reference to FIG. 9, drill pipe protector 920 is depicted, including drill pipe protector body 922, which may be formed of any material, such as molded rubber, nylon, plastic, polymer, polyurethane, synthetic polyamide, or polyether ether ketone (PEEK). Drill pipe protector body 922 includes base 924 and protrusions 926, which extend outward from base 924. Attached to, embedded within, or inserted within protrusions 926 are polycrystalline diamond elements 14 positioned to engage with, for example, casing during drilling operations. Drill pipe may be positioned within opening 928, such that drill pipe protector body 922 is positioned about drill pipe, and between drill pipe and casing.

Drill pipe protector 920 in FIG. 9 is a wedgelift drill pipe-protector. As would be understood by one skilled in the art, drill pipe protector 920 may be coupled to drill pipe via latch pins, such that the drill pipe is positioned within opening 928. Drill pipe protector 920 is slidingly engageable with drill pipe, such that drill pipe protector 920 is movable axially along the length of the drill pipe during operation of the drill pipe. During drilling, the drill pipe rotates within and relative to drill pipe protector 920. Protrusions 926 of drill pipe protector 920 extend outward, away from the drill pipe, by a distance that is sufficient to prevent the drill bit, bottom hole assembly, and other components of the drill string from engaging with the casing. That is, protrusions 926 extend outward, away from the drill pipe, such that protrusions 926 and/or polycrystalline diamond elements 14 thereon engage with the casing while keeping the drill bit, bottom hole assembly, and other components of the drill string spaced apart from the casing. For example, wherein the drill pipe couples with a downhole tool, such as a drill bit, the drill pipe typically includes threading therein to couple with the tool. The portion of the drill pipe that includes the threading is typically thicker than other portions of the drill pipe to compensate for the loss of metal due to the presence of threading. At this thicker part of the drill pipe, referred to as the "upset", the drill pipe has a larger outer diameter as a result of the additional thickness. The protrusions 926, in such an embodiment, extend outward and away from the drill pipe by a distance that is sufficient to prevent the upset of the drill pipe from engaging with the casing. Thus, in operation the drill pipe protectors disclosed herein contact the internal diameter of a well (e.g., the casing) when the drill pipe deflects off center in the casing or wellbore to protect the casing or wellbore from contact with the drill pipe or portions thereof during rotation of the drill pipe. In some embodiments, the drill pipe protector disclosed herein is a pipe protector in accordance with FIG. 7 of U.S. Pat. No. 6,378,633, with the addition of the polycrystalline diamond elements disclosed herein.

Polycrystalline Diamond

The technology of the present application preferably employs convex polycrystalline diamond elements, preferably polished polycrystalline diamond compact (PDC) elements, to provide primary, concurrent, or back-up wear resistance capability to protectors for drill pipe or sucker rods. However, the polycrystalline diamond elements of the present technology may alternatively be planar with radiused or highly radiused edges. The polycrystalline diamond elements of the current application may be, for example, thermally stable polycrystalline diamond or PDC. In some embodiments, the polycrystalline diamond elements are backed (e.g., supported) or unbacked (e.g., unsupported), such as by tungsten carbide. As would be understood by one skilled in the art, the polycrystalline diamond elements disclosed herein may be non-leached, leached, leached and backfilled, or coated (e.g., via CVD) all by methods known in the art.

In some embodiments, the polycrystalline diamond elements disclosed herein may have diameters as small as 3 mm (about ⅛") or as large as 75 mm (about 3"), for example, depending on the application and the configuration and diameter of the engaged surface. Some of the polycrystalline diamond elements disclosed herein will have diameters of from 8 mm (about 5/16") to 25 mm (about 1"). One skilled in the art would understand that the polycrystalline diamond elements are not limited to these particular dimensions and may vary in size and shape depending on the particular application.

In certain applications, the polycrystalline diamond elements disclosed herein have increased cobalt content transitions layers between the outer polycrystalline diamond surface and a supporting tungsten carbide slug. In some applications, the polycrystalline diamond elements disclosed herein may be unsupported by tungsten carbide and may be substantially "standalone", discrete polycrystalline diamond bodies that are directly mounted (e.g., onto tubular member). In embodiments where the polycrystalline diamond elements are planar face or domed polycrystalline diamond elements, the polycrystalline diamond elements may be mounted in a manner to allow the polycrystalline diamond elements to rotate about its own axis. Reference is made to U.S. Pat. No. 8,881,849, to Shen et. al., as a non-limiting example of methods to provide for a polycrystalline diamond element that spins about its own axis while in facial contact with a diamond reactive material.

Although the polycrystalline diamond elements are most commonly available in cylindrical shapes, it is understood that the technology of the application may be practiced with polycrystalline diamond elements that are square, rectangular, oval, any of the shapes described herein with reference to the Figures, or any other appropriate shape known in the art.

In some embodiments, the polycrystalline diamond elements are subjected to edge radius treatment. In some embodiments of the technology of this application that employ planar or concave polycrystalline diamond elements, it is preferred to employ edge radius treatment of such polycrystalline diamond elements. One purpose of employing an edge radius treatment is to reduce or avoid potential for outer edge cutting or scribing at the outer limits of the linear engagement area of a given polycrystalline diamond element with the opposing tubular (e.g., a curved surface).

The polycrystalline diamond elements of the present application may be deployed in a manner that preferably precludes any edge or sharp contact between the polycrystalline diamond elements and ferrous materials with which they are slidingly engaged (e.g., ferrous casing or production tubing). The preclusion of edge contact can overcome the potential for machining of the ferrous material and chemical interaction between the diamond and ferrous material.

Mounting of Polycrystalline Diamond

In some embodiments, the polycrystalline diamond elements of the present application may be mounted on a metal frame and over-molded by a thermoplastic material, or other common materials used for protectors. The polycrystalline elements of the present application may be underexposed, flush mounted, or exposed relative to the protector or guide body.

In certain embodiments, the polycrystalline diamond elements of the present application may be molded directly into protector materials and retained therein. Such molding may occur directly onto the parent tubular or may occur separate from the parent tubular and then the molded parts may be attached in a separate step. Alternatively, sockets may be molded into the thermoplastic or alternative body material and the polycrystalline diamond elements may then be mounted afterwards using gluing, or threading or other methods as known in the art. In some embodiments, the polycrystalline diamond elements may be mounted on couplings of a sucker rod assembly. In yet another alternative the polycrystalline diamond elements of the current application may be attached to a metal frame that is not over molded but, rather, acts as the primary frame with the polycrystalline diamond elements providing substantially all of the wear resistance and stand-off distance of the protector. In another alternative embodiment, the polycrystalline diamond elements of the current technology may be mounted in subassemblies that allow for the polycrystalline diamond elements to rotate about their own axis, as is known in the art.

The polycrystalline diamond elements of the current technology may be recovered from used protectors or guides and reused in freshly molded or deployed protectors or guides. The ability to recover and reuse the polycrystalline diamond elements reduces the ultimate cost of the use of the technology.

Lapping or Polishing

In certain applications, the polycrystalline diamond element, or at least the engagement surface thereof, is lapped or polished, optionally highly lapped or highly polished. As used herein, a surface is defined as "highly lapped" if the surface has a surface finish (Ra) of 20 μin Ra or about 20 μin Ra, such as a surface finish (Ra) ranging from about 18 to about 22 μin Ra. As used herein, a surface is defined as "polished" if the surface has a surface finish (Ra) of less than about 10 μin Ra, or of from about 2 to about 10 μin Ra. As used herein, a surface is defined as "highly polished" if the surface has a surface finish (Ra) of less than about 2 μin Ra, or from about 0.5 μin Ra to less than about 2 μin Ra. In some embodiments, the engagement surface has a surface finish (Ra) ranging from 0.5 μin Ra to 40 μin Ra, or from 2 μin Ra to 30 μin Ra, or from 5 μin Ra to 20 μin Ra. or from 8 μin Ra to 15 μin Ra, or less than or equal to 32 μin Ra, or less than 20 μin Ra, or less than 10 μin Ra, or less than 2 μin Ra, or any range therebetween. Polycrystalline diamond that has been polished to a surface finish (Ra) of 0.5 μin Ra has a coefficient of friction that is about half of standard lapped polycrystalline diamond with a surface finish of 20-40 μin Ra. U.S. Pat. Nos. 5,447,208 and 5,653,300 to Lund et al. provide disclosure relevant to polishing of polycrystalline diamond. As would be understood by one skilled in the art, surface finish may be measured with a profilometer or with Atomic Force Microscopy. Surface finish may be determined in accordance with ASME B46.1-2009.

Diamond Reactive Material

In some embodiments, the opposing tubular, or at least the surface thereof, is or includes a diamond reactive material. As used herein, a "diamond reactive material" is a material that contains more than trace amounts of diamond solvent-catalyst. As used herein, a diamond reactive material that contains more than "trace amounts" of diamond solvent-catalyst contains at least 2 percent by weight (wt. %) diamond solvent-catalyst based on a total weight of the diamond reactive material. In some embodiments, the diamond reactive materials disclosed herein contain from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of diamond solvent-catalyst based on a total weight of the diamond reactive material. Some examples of known diamond solvent-catalysts (also referred to as "diamond catalyst," "diamond solvent," "diamond catalyst-solvent," "catalyst-solvent," or "solvent-catalyst") are disclosed in: U.S. Pat. Nos. 6,655,845; 3,745,623; 7,198,043; U.S. Pat. Nos. 8,627,904; 5,385,715; 8,485,284; 6,814,775; 5,271,749; 5,948,541; 4,906,528; U.S. Pat. Nos. 7,737,377; 5,011,515; 3,650,714; U.S. Pat. Nos. 2,947,609; and 8,764,295. As would be understood by one skilled in the art, diamond solvent-catalysts are chemical elements, compounds, or materials (e.g., metals) that are capable of reacting with polycrystalline diamond (e.g., catalyzing and/or solubilizing), resulting in the graphitization of the polycrystalline diamond, such as under load and at a temperature at or exceeding the graphitization temperature of diamond (i.e., about 700° C.). Thus, diamond reactive materials include materials that, under load and at a temperature at or exceeding the graphitization temperature of diamond, can lead to wear, sometimes rapid wear, and failure of components formed of polycrystalline diamond, such as diamond tipped tools. Diamond solvent-catalysts include, but are not limited to, iron, cobalt, nickel, ruthenium, rhodium, palladium, chromium, manganese, copper, titanium, and tantalum.

Diamond reactive materials include, but are not limited to, metals, metal alloys, and composite materials that contain more than trace amounts of diamond solvent-catalyst. In some embodiments, the diamond reactive materials are in the form of hard facings, coatings, or platings. For example, and without limitation, the diamond reactive material may contain ferrous, cobalt, nickel, ruthenium, rhodium, palladium, chromium, manganese, copper, titanium, tantalum, or alloys thereof. In some embodiments, the diamond reactive material is a steel or cast iron. In some embodiments, the diamond reactive material is a superalloy including, but not limited to, iron-based, cobalt-based and nickel-based superalloys. In some embodiments, the opposing engagement surface (i.e., the surface in opposing engagement with the polycrystalline diamond engagement surface) is a metal surface. As used herein, a metal surface is a surface of a material that is primarily metal, by weight percent. In some embodiments, the opposing engagement surface contains from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of diamond solvent-catalyst based on a total weight of the material of the opposing engagement surface. In some embodiments, the opposing engagement surface contains from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of iron, cobalt, nickel, ruthenium, rhodium, palladium, chromium, manganese, copper, titanium, or tantalum. In some embodiments, the opposing engagement surface contains at least 50 wt. %, at least 55 wt. %, at least 60 wt. %, at least 65 wt. %, at least 70 wt. %, at least 75 wt. %, at least 80 wt. %, at least 85 wt. %, at least 90 wt. %, at least 95 wt. %, or 100 wt. % of a metal, where the metal is a diamond reactive material.

In certain embodiments, the opposing tubular, or at least the surface thereof, is not and/or does not include (i.e., specifically excludes) so called "superhard materials." As would be understood by one skilled in the art, "superhard materials" are a category of materials defined by the hardness of the material, which may be determined in accordance with the Brinell, Rockwell, Knoop and/or Vickers scales. For example, superhard materials include materials with a hardness value exceeding 40 gigapascals (GPa) when measured by the Vickers hardness test. As used herein, superhard materials include materials that are at least as hard as tungsten carbide tiles and/or cemented tungsten carbide, such as is determined in accordance with one of these hardness scales, such as the Brinell scale. One skilled in the art would understand that a Brinell scale test may be performed, for example, in accordance with ASTM E10-14; the Vickers hardness test may be performed, for example, in accordance with ASTM E384; the Rockwell hardness test may be performed, for example, in accordance with ASTM E18; and the Knoop hardness test may be performed, for example, in accordance with ASTM E384. The "superhard materials" disclosed herein include, but are not limited to, tungsten carbide (e.g., tile or cemented), infiltrated tungsten carbide matrix, silicon carbide, silicon nitride, cubic boron nitride, and polycrystalline diamond. Thus, in some embodiments, the opposing tubular is partially or entirely composed of material(s) (e.g., metal, metal alloy, composite) that is softer (less hard) than superhard materials, such as less hard than tungsten carbide (e.g., tile or cemented), as determined in accordance with one of these hardness tests, such as the Brinell scale. As would be understood by one skilled in the art, hardness may be determined using the Brinell scale, such as in accordance with ASTM E10-14. As would be understood by one skilled in the art, a "superalloy" is a high-strength alloy that can withstand high temperatures. In certain embodiments, the opposing tubular, or at least the surface thereof, is not and/or does not include (i.e., specifically excludes) diamond.

Figure 12:
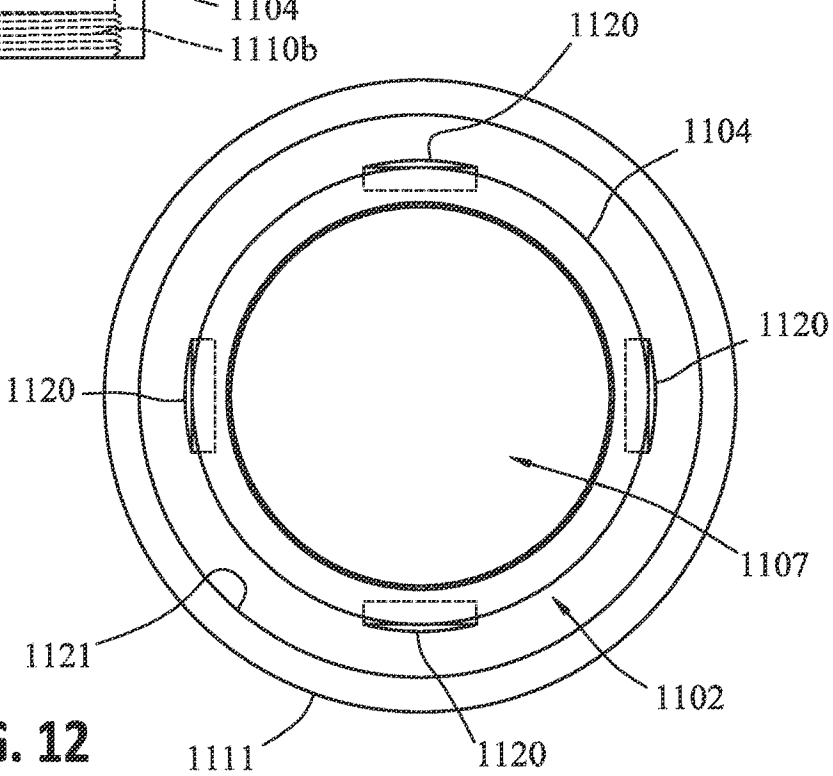
FIG. 12 is an end view of a sucker rod coupler positioned within production tubing.
Figure 13:
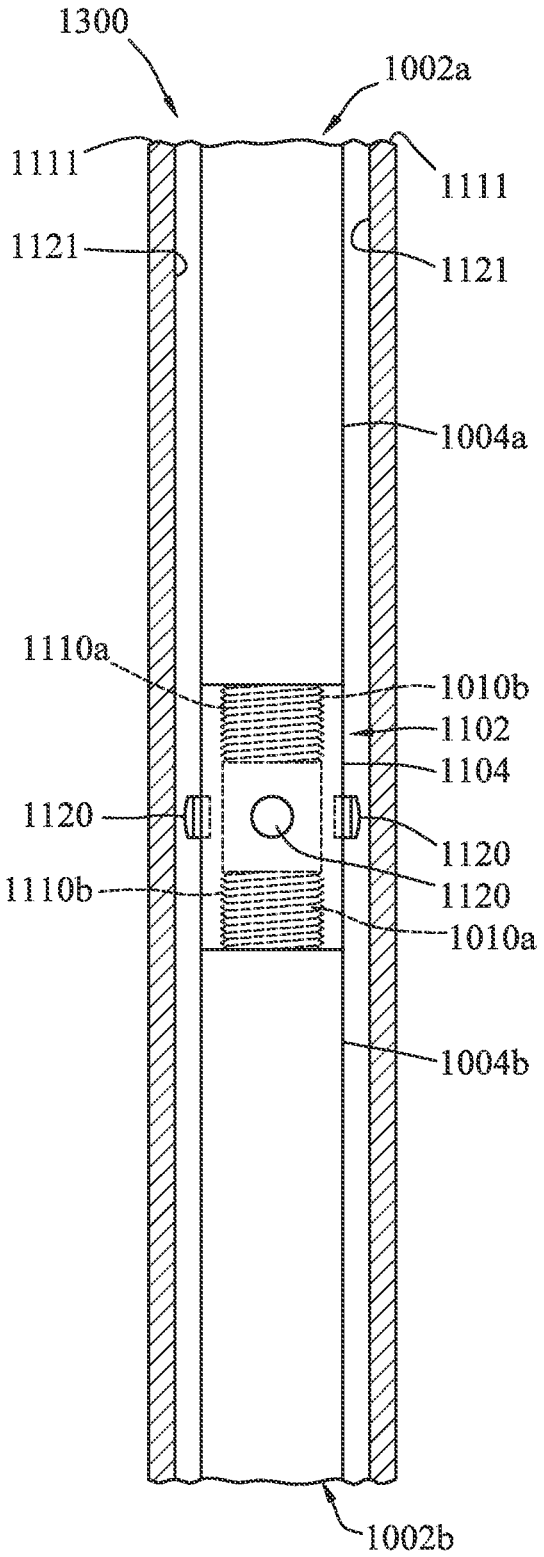
FIG. 13 is a cross-sectional view of a sucker rod string positioned within production tubing.

Some examples of surfaces disclosed herein that may be or include diamond reactive material are: inner wall 32 shown in FIGS. 2A, 2B, 2E and 2F; outer wall 36 shown in FIGS. 2A and 2B; outer wall 46 shown in FIGS. 2C-2F; innerwall 42 shown in FIG. 2C; inner surface 107 shown in FIG. 4D; outer surface 706 shown in FIGS. 7A and 7B; inner wall 791 shown in FIG. 7C; opposing engagement surface 1121 shown in FIGS. 12 and 13; and internal wall shown in FIG. 15.

Rod Couplings with Polycrystalline Diamonds

In some embodiments, the engagement interfaces disclosed herein are provided on the couplings of a tubular, such as a rod (e.g., a sucker rod), rather than or in addition to being on a guide of the tubular (e.g., rod). In some such embodiments, sucker rod couplers ar or include the engagement interfaces. The engagement interfaces on the couplings can interface the engagement between a sucker rod string movably positioned within production tubing. A sucker rod is a rod (e.g., a steel rod) that is used to make up the mechanical assembly between the surface and downhole components of a rod pumping system. A sucker rod string or assembly may include a plurality of sucker rods coupled together. In some embodiments, the plurality of sucker rods are threadably coupled together. For example, a rod coupler may be coupled with a first sucker rod and with a second sucker rod such that the first and second sucker rods are coupled together via the rod coupler. Exemplary sucker rods may be from 20 to 40 feet, or from 24 to 35 feet, or from 25 to 30 feet in length, and may be threaded at each end to enable coupling with the rod coupler.

Figure 10:
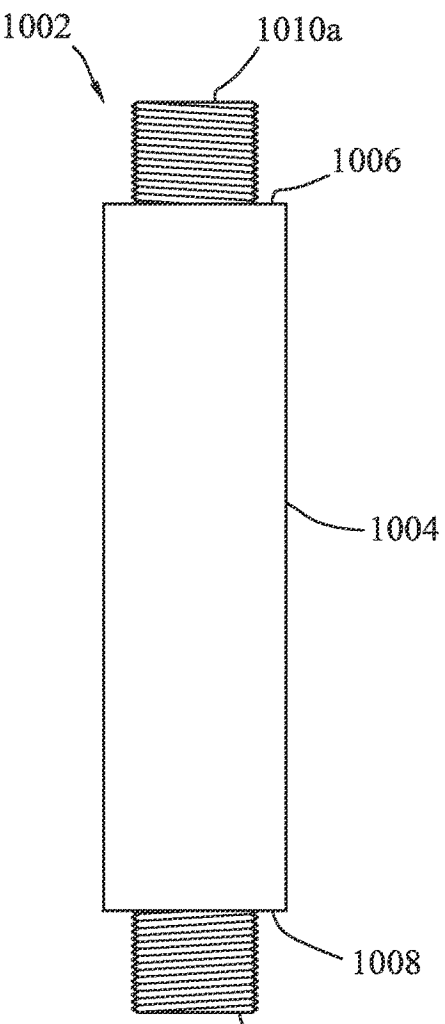
FIG. 10 depicts a sucker rod.

With references to FIGS. 10-14, a sucker rod coupler having polycrystalline diamond engagement surfaces thereon is shown and described. FIG. 10 depicts sucker rod 1002. Sucker rod 1002 includes rod body 1004. Rod body 1004 may be a metal body, such as steel. Rod body 1004 has first end 1006 and second end 1008. At each end of rod body 1004, sucker rod 1002 includes a threaded end 1010*a* and 1010*b*. Threaded ends 1010*a* and 1010*b* allow for sucker rod 1002 to be threadably coupled with other components, such as other sucker rods. While shown as including threaded ends, the sucker rods disclosed herein are not limited to threaded couplings. While shown as including threaded ends on both ends, some embodiments of the sucker rods disclosed herein only include threaded couplings (or other couplings) at one end of the rod body. While threaded ends 1010*a* and 1010*b* are shown as male threads, some embodiments of the sucker rods disclosed herein include female threads.

Figure 11:
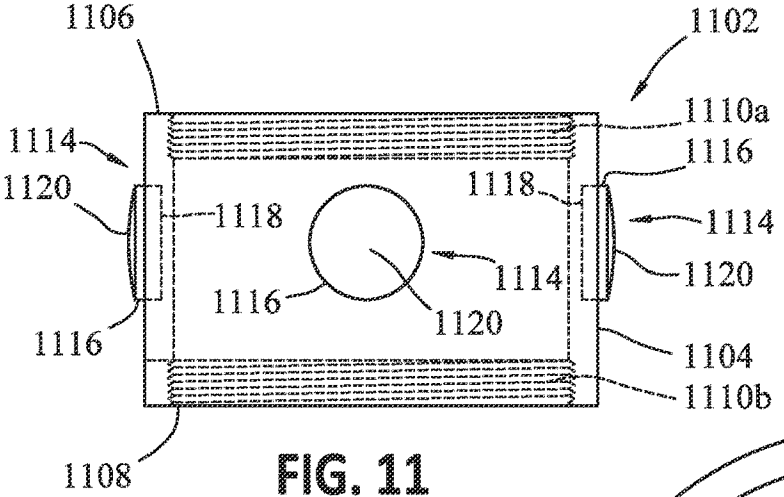
FIG. 11 depicts a sucker rod coupler.

FIG. 11 depicts sucker rod coupler 1102. Sucker rod coupler 1102 includes coupler body 1104. Coupler body 1104 may be a metal body, such as steel. Sucker rod coupler 1102 includes threading 1110*a* and 1110*b* formed on an internal diameter of coupler body 1104 at each end 1106 and 1108 of coupler body 1104. Threading 110*a* and 1110*b* allows sucker rod coupler 1102 to be threadably coupled with two different sucker rods such that sucker rod coupler 1102 couples the two different sucker rods together. That is, threading on a first sucker rod can be threadably coupled with threading 1110*a*, and threading on a second sucker rod can be threadably coupled with threading 1110*b*. For example, two sucker rods 1002 the same as shown in FIG. 10 can threadably coupled with sucker rod coupler 1102. It should be noted that the sucker rod in FIG. 10 and the sucker rod coupler in FIG. 11 are not drawn to scale relative to one another. While shown as including threaded ends, the sucker rod couplers disclosed herein are not limited to threaded couplings. While threading 1110*a* and 1110*b* are shown as female threads, some embodiments of the sucker rod couplers disclosed herein include male threads.

Sucker rod coupler 1102 includes a plurality of polycrystalline diamond elements 1114 on coupler body 1104. The polycrystalline diamond elements 1114 may be the same or similar to those described throughout this disclosure, including those described with reference to FIGS. 1A-9. As shown in FIG. 11, polycrystalline diamond elements 1114 include polycrystalline diamonds 1116 supported on supports 1118 (e.g., tungsten carbide supports). The sucker rod couplers disclosed herein are not limited to including polycrystalline diamond elements that are supported on supports, and may include unsupported polycrystalline diamond elements. Each polycrystalline diamond 1116 has an engagement surface 1120. In some embodiments, the engagement surfaces 1120 are dome shaped, curved, or otherwise contoured. The engagement surfaces 1120 can be convex. In some embodiments, the engagement surfaces 1120 have a curvature that matches or is less than the curvature of coupler body 1104. For example, with reference to FIG. 12, the exterior surface of coupler body 1104 is shown as having a curvature. Engagement surfaces 1120 can have this same surface curvature as coupler body 1104. In other embodiments, engagement surfaces 1120 have a surface curvature that is less than the surface curvature of coupler body 1104. In some embodiments, engagement surfaces 1120 are flush with the exterior surface of coupler body 1104. In some embodiments, engagement surfaces 1120 are raised above the exterior surface of coupler body 1104 (as shown). In some embodiments, engagement surfaces 1120 are recessed below the exterior surface of coupler body 1104. As shown in FIG. 12, coupler body 1104 (as well as the sucker rods to which it is attached) can be hollow, including a cavity 1107 that defines a flow path for fluids therethrough. In FIG. 12, the sucker rod coupler 1102 and the sucker rods to which it is attached (not show) is positioned within production tubing 1111. In operation, should the sucker rod string (i.e., a plurality of threadably coupled sucker rods and sucker rod couplers) engage with the production tubing 1111, the engagement surfaces 1120 will interface that engagement. That is, engagement surfaces 1120 will engage with the opposing engagement surfaces 1121 of production tubing (i.e., the internal diameter of the production tubing). Thus, the engagement surfaces 1120 will prevent, or at least reduce, the occurrence of the outer surface of the sucker rod body or the outer surface of the sucker rod coupler body from engaging with the production tubing 1111. As such, wear on the outer surface of the sucker rod body or the outer surface of the sucker rod coupler body as a result of engagement with the production tubing is prevented or reduced. Correspondingly, wear on the inner surface of the production tubing is prevented or reduced.

Figure 14:
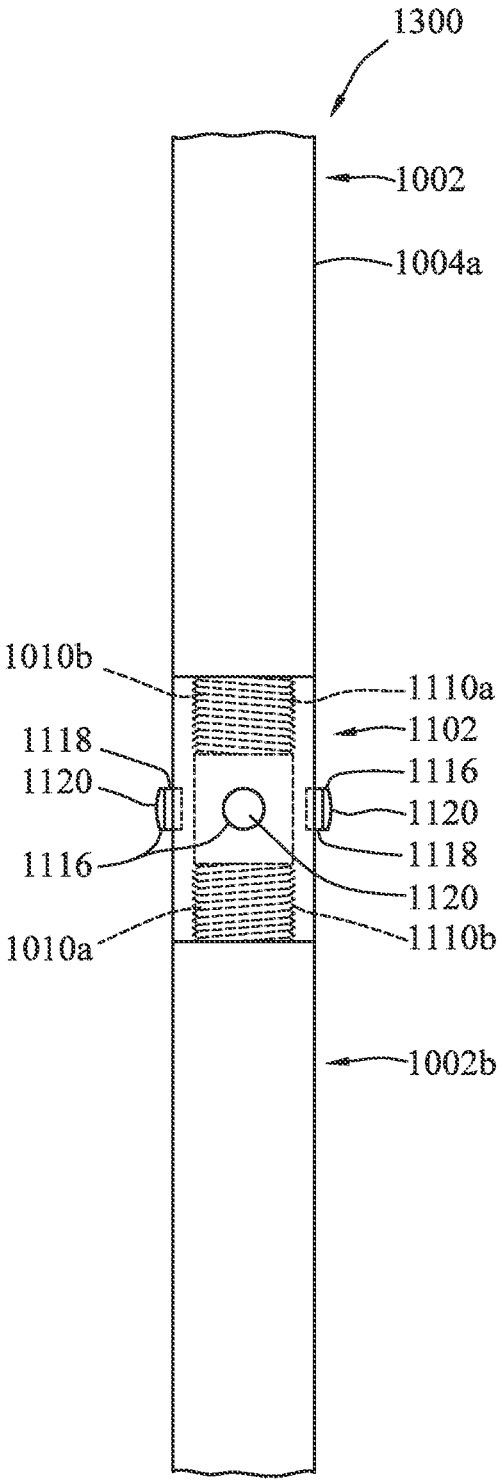
FIG. 14 depicts the sucker rod string of FIG. 13 in isolation from the production tubing.

FIG. 13 depicts a sucker rod string 1300, including two sucker rods 1002*a* and 1002*b* each threadably engaged with a sucker rod coupler 1102. Sucker rod string 1300 is positioned within production tubing 1111. Engagement surfaces 1120 are raised above the exterior surface of sucker rod coupler body 104 and sucker rod bodies 1004*a* and 1004*b*, such that engagement surfaces 1120 are positioned and arranged to interface any engagement between sucker rod string 1300 and production tubing 1111. In some embodiments, the opposing engagement surface 1121 is a diamond reactive material, such as steel. FIG. 14 depicts the sucker rod string 1300 in isolation from the production tubing. One skilled in the art would understand that sucker rod strings typically include more than two individual segments of sucker rods and more than one sucker rod coupler, and that the embodiment shown in FIGS. 13 and 14 is simplified and for the purpose of explaining the coupling between two adjacent segments of sucker rod. The embodiments shown in FIGS. 10-14 show that polycrystalline diamond elements can be mounted directly onto the sucker rod couplers. In some embodiments, the concepts described with respect to FIGS. 10-14 can be combined with those described herein in reference to FIGS. 1A-5 where sucker rod guides are provided with polycrystalline diamond elements that act as engagement interfaces. In some embodiments, the addition of sucker rod guides to sucker rod strings stiffens the sucker rod strings, complementing the protection provided to the string by the PDCs on sucker rod couplers. In such embodiments, the sucker rod guides may also include PDCs thereon, or may lack PDCs. When the sucker rod string includes sucker rod guides, the guides may be of a smaller diameter than traditional rod guides. In other embodiments, the sucker rod string with polycrystalline diamond elements on the sucker rod couplers lacks additional sucker rod guides, as the sucker rod couplers themselves provide the dual function of sucker rod couplers and sucker rod guides (rod centralizers).

Tubulars Joints with Polycrystalline Diamonds

Figure 15A:
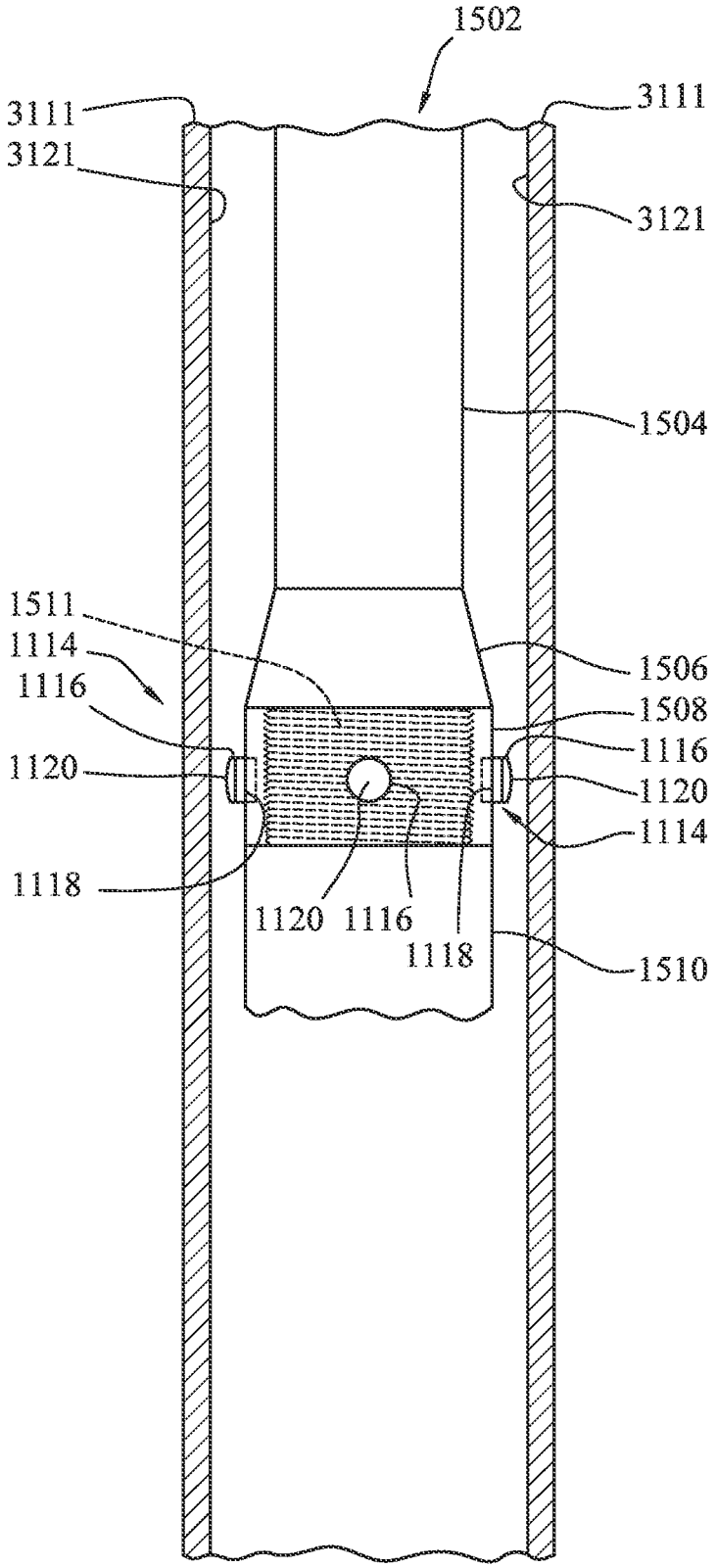
FIG. 15A depicts a tubular positioned in a casing, with the tubular having a tool joint with polycrystalline diamond elements.

In some embodiments, the tubulars disclosed herein include joints for coupling with other components, such as with other tubulars or with tools (e.g., a tool joint). FIG. 15A depicts a tubular having a joint with polycrystalline diamond elements positioned on the joint. In FIG. 15, tubular 1502, which may be a drill pipe, is positioned within tubing 3111, which may be casing in a wellbore. Tubing 3111 has an internal wall 3121. Tubular 1502 includes body 1504, which expands at body section 1506 to a larger diameter joint section 1508. Joint section 1508 includes threading 1511 on an internal diameter thereof, which allowed tubular 1502 to be coupled with tools, other tubulars, or other components. As shown, joint section 1508 is coupled with tool 1510 (only a portion of which is depicted). Tool 1510 may be, for example, a drill bit.

Figure 15B:
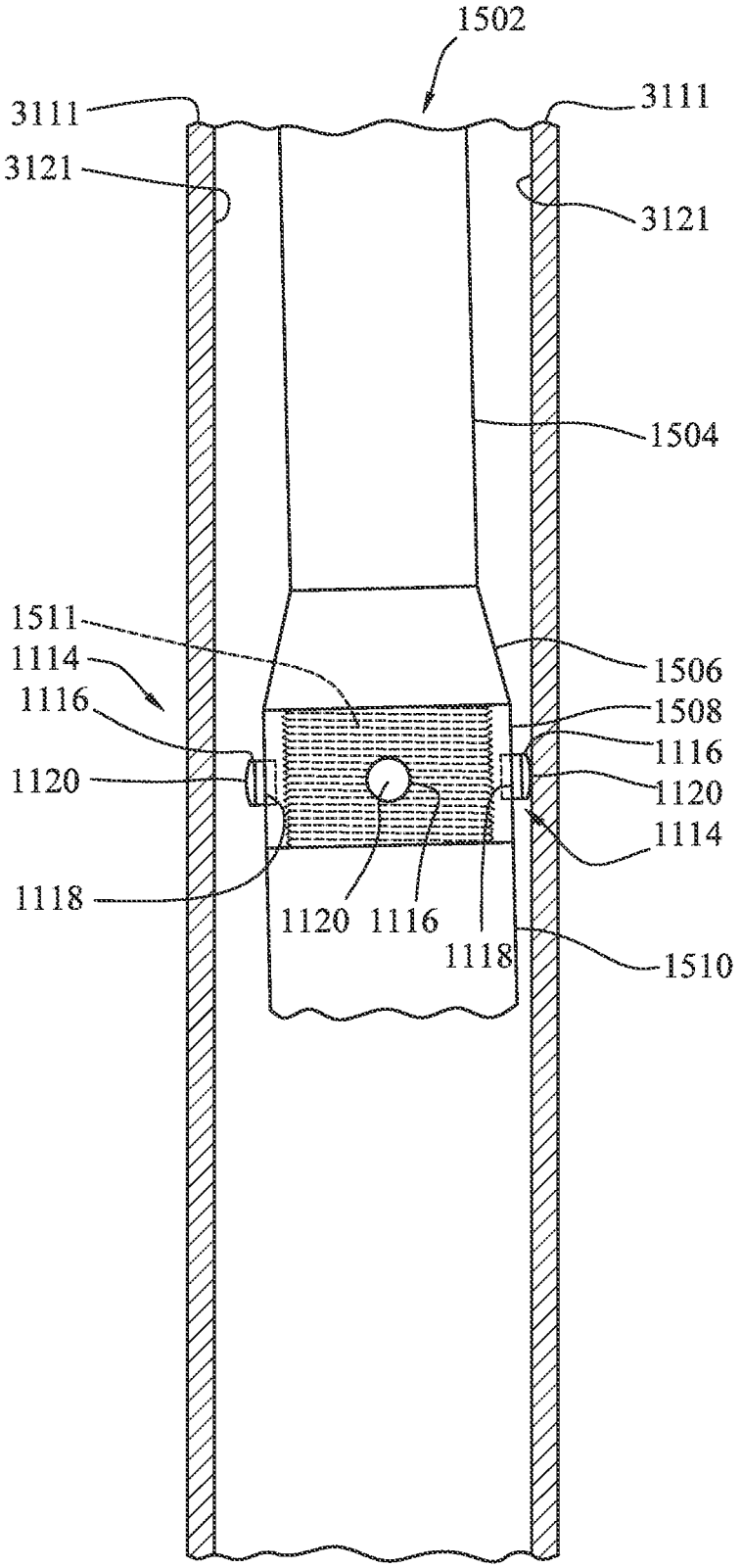
FIG. 15B depicts the tubular of FIG. 15A, with the polycrystalline diamond elements engaged with a surface of the casing.

A plurality of polycrystalline diamond elements 1114 are positioned on joint section 1508, such that engagement surfaces 1120 interface engagement between tubular 1502 and opposing engagement surface 1321. FIG. 15B depicts the tubular 1502 of FIG. 15A, but at an angle within tubing 3111. With tubular 1502 positioned at an angle within tubing 3111, at least some of the engagement surfaces 1120 are in engagement with internal wall 3121 of tubing 3111. Thus, the engagement surfaces 1120 of the plurality of polycrystalline diamond elements 1114 engage with tubing 3111 rather than other portions of tubular 1502. The engagement surfaces of a sucker rod string (e.g., sucker rod string 1300 shown in FIG. 13) function in substantially the same manner, such that the engagement surfaces of the plurality of polycrystalline diamond elements thereon will engage with the production tubing rather than other portions of the sucker rod string when the sucker rod string is at an angle within the production tubing.

Thus, in some embodiments, the PDC elements disclosed herein are positioned on a tool joint. The tool joint may be at one end of a drill pipe, for example, that includes threads and has a larger outer diameter (OD) than a remainder of the drill pipe. In some embodiments, tubulars with such tool joints (e.g., joint section 1508) do not have couplers, such as those shown in FIGS. 10-14, because the tool joint for coupling with other components is integral with the tubular. Thus, some embodiments provide for the positioning of PDC elements on and/or around such tool joints.

From the descriptions and figures provided above it can readily be understood that the technology of the present application may be employed in a broad spectrum of applications, including those in downhole environments. The technology provided herein additionally has broad application to other industrial applications. One skilled in the art would understand that the present disclosure is not limited to use with drill pipes and sucker rods or even to use in downhole applications, and that the concepts disclosed herein may be applied to the engagement between any surfaces.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A sucker rod assembly, the assembly comprising:

production tubing positioned within a wellbore, the production tubing having an internal cavity wall defining a cavity of the production tubing, wherein the internal cavity wall comprises a metal surface comprising a metal that includes at least 2 wt. % of a diamond solvent-catalyst based on a total weight of the metal;

a sucker rod string positioned within the cavity of the production tubing, the sucker rod string comprising a first sucker rod coupled with a second sucker rod via a sucker rod coupler; and wherein the sucker rod coupler comprises a polycrystalline diamond element, wherein the polycrystalline diamond element has a polycrystalline diamond engagement surface having a surface finish of at most 20 μin Ra, and wherein the polycrystalline diamond engagement surface is positioned along the sucker rod string to interface engagement between the sucker rod string and the metal surface of the production tubing.

2. The assembly of claim 1, wherein an exterior surface of the sucker rod coupler has a first curvature, wherein the polycrystalline diamond engagement surface has a second curvature, and wherein the second curvature is equal to or less than the first curvature.

3. The assembly of claim 1, wherein the polycrystalline diamond engagement surface has a surface finish of at most 2 μin Ra.

4. The assembly of claim 1, wherein the diamond solvent-catalyst is selected from the group consisting of: iron, titanium, cobalt, nickel, ruthenium, rhodium, palladium, chromium, manganese, copper, tantalum, and combinations thereof.

5. The assembly of claim 1, wherein the metal comprises from 55 wt. % to 100 wt. % of the diamond solvent-catalyst based on the total weight of the metal.

6. The assembly of claim 1, wherein the metal is softer than tungsten carbide.

7. A method of interfacing engagement between a sucker rod string and production tubing, the method comprising:

providing a sucker rod string, the sucker rod string comprising a first sucker rod coupled with a second sucker rod via a sucker rod coupler;

positioning a polycrystalline diamond element on the sucker rod coupler, wherein the polycrystalline diamond element has a polycrystalline diamond engagement surface having a surface finish of at most 20 μin Ra; and positioning the sucker rod string within a cavity of a production tubing such that the polycrystalline diamond engagement surface is positioned along the sucker rod string to interface engagement between the sucker rod string and a metal surface of the production tubing, wherein the metal surface comprises a metal that includes at least 2 wt. % of a diamond solvent-catalyst based on a total weight of the metal.

8. The method of claim 7, wherein the diamond solvent-catalyst is selected from the group consisting of: iron, titanium, cobalt, nickel, ruthenium, rhodium, palladium, chromium, manganese, copper, tantalum, and combinations thereof.

9. The method of claim 7, wherein the metal comprises from 55 to 100 wt. % of the diamond solvent-catalyst based on the total weight of the metal.

10. The method of claim 7, wherein the metal is softer than tungsten carbide.

11. A downhole tubular assembly, the assembly comprising:

a tubular comprising a first end, a second end, and a tool joint at the second end;

a polycrystalline diamond element coupled with the tool joint, wherein the polycrystalline diamond element has a polycrystalline diamond engagement surface having a surface finish of at most 20 μin Ra; and casing in a wellbore, the casing having an internal wall having a metal surface, the metal surface comprising a metal that includes at least 2 wt. % of a diamond solvent-catalyst based on a total weight of the metal;

wherein the tubular is positioned within the casing such that the polycrystalline diamond engagement surface is positioned to interface engagement between the tool joint and the metal surface.

12. The assembly of claim 11, wherein the tubular is a drill pipe.

13. The assembly of claim 12, further comprising a drill bit coupled with the tool joint.

14. The assembly of claim 11, wherein an outer diameter of the tubular is larger at the tool joint than a diameter of the tubular between the tool joint and the first end.

15. The assembly of claim 11, wherein the polycrystalline diamond engagement surface has a surface finish of at most 2 μin Ra.

16. The assembly of claim 11, wherein the diamond solvent-catalyst is selected from the group consisting of: iron, titanium, cobalt, nickel, ruthenium, rhodium, palladium, chromium, manganese, copper, tantalum, and combinations thereof.

17. The assembly of claim 11, wherein the metal comprises from 55 to 100 wt. % of the diamond solvent-catalyst based on the total weight of the metal.

18. The assembly of claim 11, wherein the metal is softer than tungsten carbide.

19. A method of interfacing engagement between a tool joint and casing, the method comprising:

providing a tubular comprising a first end, a second end, and a tool joint at the second end;

coupling a polycrystalline diamond element with the tool joint, wherein the polycrystalline diamond element has a polycrystalline diamond engagement surface having a surface finish of at most 20 μin Ra; and positioning the tubular in casing in a wellbore such that the polycrystalline diamond engagement surface is positioned to interface engagement between the tool joint and a metal surface of the casing, wherein the metal surface comprises a metal that includes at least 2 wt. % of a diamond solvent-catalyst based on a total weight of the metal.

20. The method of claim 19, wherein the diamond solvent-catalyst is selected from the group consisting of: iron, titanium, cobalt, nickel, ruthenium, rhodium, palladium, chromium, manganese, copper, tantalum, and combinations thereof.

21. The method of claim 19, wherein the metal comprises from 55 to 100 wt. % of the diamond solvent-catalyst based on the total weight of the metal.

22. The method of claim 19, wherein the metal is softer than tungsten carbide.

23. A tubular assembly, the assembly comprising:

a first tubular positioned within a wellbore, the first tubular having an internal cavity wall defining a cavity of the first tubular, wherein the internal cavity wall comprises a metal surface comprising a metal that includes at least 2 wt. % of iron, titanium, cobalt, nickel, ruthenium, rhodium, palladium, chromium, manganese, copper, tantalum, or combinations thereof based on a total weight of the metal;

a second tubular positioned within the cavity of the first tubular; and a polycrystalline diamond element coupled with the second tubular, wherein the polycrystalline diamond element has a polycrystalline diamond engagement surface having a surface finish of at most 20 μin Ra, and wherein the polycrystalline diamond engagement surface is positioned along the second tubular to interface engagement between the second tubular and the metal surface.

24. The assembly of claim 23, wherein the first tubular comprises production tubing;

wherein the second tubular comprises a sucker rod string, the sucker rod string comprising a first sucker rod coupled with a second sucker rod via a sucker rod coupler; and wherein the polycrystalline diamond element is coupled with the sucker rod coupler.

25. The assembly of claim 23, wherein the first tubular comprises casing;

wherein the second tubular comprises a first end, a second end, and a tool joint at the second end;

wherein the polycrystalline diamond element is coupled with the tool joint; and wherein the second tubular is positioned within the casing such that the polycrystalline diamond engagement surface is positioned to interface engagement between the tool joint and the metal surface.

* * * * *